US010310419B2

(12) United States Patent
Nagata et al.

(10) Patent No.: US 10,310,419 B2
(45) Date of Patent: Jun. 4, 2019

(54) IMAGE FORMING APPARATUS AND CARRIER SEPARATING DEVICE

(71) Applicant: CANON KABUSHIKI KAISHA, Tokyo (JP)

(72) Inventors: Teppei Nagata, Abiko (JP); Akinori Tanaka, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/556,683

(22) PCT Filed: May 27, 2016

(86) PCT No.: PCT/JP2016/066512
§ 371 (c)(1),
(2) Date: Sep. 8, 2017

(87) PCT Pub. No.: WO2016/190448
PCT Pub. Date: Dec. 1, 2016

(65) Prior Publication Data

US 2018/0059582 A1 Mar. 1, 2018

(30) Foreign Application Priority Data

May 27, 2015 (JP) ..... 2015-107897

(51) Int. Cl.
*G03G 15/08* (2006.01)
*G03G 15/10* (2006.01)
(Continued)

(52) U.S. Cl.
CPC ..... *G03G 15/105* (2013.01); *G03G 21/0088* (2013.01); *G03G 15/0815* (2013.01);
(Continued)

(58) Field of Classification Search
CPC ..... G03G 15/0815; G03G 15/0844; G03G 15/0846; G03G 15/0879; G03G 15/0887;
(Continued)

(56) References Cited

U.S. PATENT DOCUMENTS 6,440,629 B1 * 8/2002 Zhao ..... G03G 9/135 399/237
7,831,179 B2 11/2010 Oda
(Continued)

FOREIGN PATENT DOCUMENTS

CN 101256384 A 9/2008
CN 101308352 A 11/2008
(Continued)

OTHER PUBLICATIONS

Notification of Transmittal of the International Search Report and the Written Opinion dated Jul. 19, 2016, in International Application No. PCT/JP2016/066512.
(Continued)

*Primary Examiner* — Joseph S Wong
(74) *Attorney, Agent, or Firm* — Venable LLP

(57) ABSTRACT

An image forming apparatus includes an image bearing member to form a toner image on a recording material with a liquid developer containing a toner and a carrier liquid, wherein the carrier liquid contains a first substance, charged to an opposite polarity to a charge polarity of the toner, for imparting an electrical polarity to the toner, and a second substance, higher in volume resistivity than the first substance, a cleaning portion to collect the liquid developer remaining on the image bearing member after the toner image is transferred onto the recording material, a toner separating device to separate the collected liquid developer into the toner and the carrier liquid, and a carrier separating device to separate the carrier liquid into the carrier liquid
(Continued)

containing the first substance and the carrier liquid containing the second substance by applying an electric field to the carrier liquid.

17 Claims, 21 Drawing Sheets

(51) Int. Cl.

| | |
|---|---|
| ***G03G 15/11*** | (2006.01) |
| ***G03G 21/00*** | (2006.01) |
| ***G03G 21/10*** | (2006.01) |
| ***G03G 21/12*** | (2006.01) |
| ***G03G 21/16*** | (2006.01) |

(52) U.S. Cl.
CPC ..... *G03G 15/0844* (2013.01); *G03G 15/0879* (2013.01); *G03G 15/0887* (2013.01); *G03G 15/0896* (2013.01); *G03G 15/10* (2013.01); *G03G 15/104* (2013.01); *G03G 15/11* (2013.01); *G03G 21/0005* (2013.01); *G03G 21/0023* (2013.01); *G03G 21/0076* (2013.01); *G03G 21/0082* (2013.01); *G03G 21/10* (2013.01); *G03G 21/105* (2013.01); *G03G 21/12* (2013.01); *G03G 21/169* (2013.01); *G03G 21/1676* (2013.01)

(58) Field of Classification Search
CPC .. G03G 15/0896; G03G 15/10; G03G 15/104; G03G 15/105; G03G 15/11; G03G 21/0005; G03G 21/0023; G03G 21/0076; G03G 21/0082; G03G 21/0088; G03G 21/10; G03G 21/105; G03G 21/12; G03G 21/1676; G03G 21/169; G03G 2215/0626; G03G 2215/0658; G03G 2221/0036; G03G 2221/0052; G03G 2221/0057; G03G 2221/0063
See application file for complete search history.

(56) References Cited

U.S. PATENT DOCUMENTS

| | | | | |
|---|---|---|---|---|
| 7,844,204 | B2 | 11/2010 | Oda | |
| 7,890,012 | B2 | 2/2011 | Koishi et al. | |
| 8,526,841 | B2 | 9/2013 | Koishi et al. | |
| 8,862,015 | B2 | 10/2014 | Koishi et al. | |
| 2003/0175049 | A1* | 9/2003 | Ichida | G03G 15/104 399/237 |
| 2008/0205935 | A1 | 8/2008 | Oda | |
| 2009/0110423 | A1 | 4/2009 | Tanaka | |
| 2018/0107130 | A1* | 4/2018 | Nagata | G03G 9/125 |

FOREIGN PATENT DOCUMENTS

| | | | |
|---|---|---|---|
| JP | 2000-242085 | A | 9/2000 |
| JP | 2001-180460 | A | 7/2001 |
| JP | 2002-023583 | A | 1/2002 |
| JP | 2004-117772 | A | 4/2004 |
| JP | 2005-077896 | A | 3/2005 |
| JP | 2006-301162 | A | 11/2006 |
| JP | 2008-242433 | A | 10/2008 |
| JP | 2008-242434 | A | 10/2008 |
| JP | 2008-242435 | A | 10/2008 |
| JP | 2008-242436 | A | 10/2008 |
| JP | 2009-156935 | A | 7/2009 |
| JP | 4384884 | B2 | 12/2009 |
| JP | 2010-015033 | A | 1/2010 |
| JP | 2011-095442 | A | 5/2011 |
| RU | 2488869 | C1 | 7/2013 |

OTHER PUBLICATIONS

Teppei Nagata et al., U.S. Appl. No. 15/556,348, filed Sep. 7, 2017.
Kotaro Toritaka et al., U.S. Appl. No. 15/558,299, filed Sep. 28, 2017.
Korean Office Action dated Oct. 31, 2018, in related Korean Patent Application No. 10-2017-7036362.
Russian Office Action dated Jul. 31, 2018, in related Russian Patent Application No. 2017135422/28.
European Search Report dated Jan. 15, 2019, in related European Patent Application No. 16800152.7.

* cited by examiner

IMAGE FORMING APPARATUS AND CARRIER SEPARATING DEVICE

TECHNICAL FIELD

The present invention relates to an electrophotographic image forming apparatus, including a separating device, for forming an image with the liquid developer, and relates to the separating device for separating a toner and a carrier liquid from a liquid developer.

BACKGROUND ART

Conventionally, the image forming apparatus for forming the image with the liquid developer containing the toner and the liquid developer has been known. In the image forming apparatus, the liquid developer which is not used in an image forming step is collected and recycled. In such a recycling process of the liquid developer, toner particles which are a dispersoid in the liquid developer (liquid material) and the carrier liquid which is a dispersion medium in the liquid developer are separated, and then the carrier liquid is used again (for example, Japanese Laid-Open Patent Application 2008-242436).

However, by repeating recycling, in the carrier liquid, a substance having a low volume resistivity accumulates. Thus, a resistance of an entirety of the liquid developer lowers, so that there is a liability that an image defect generates. By periodically exchanging (replacing) a container accommodating the liquid developer, the generation of the image defect can be suppressed, but in this case, a running cost increases, as does a load of maintenance by a user or a service person.

SUMMARY OF THE INVENTION

The present invention has been accomplished in view of the above-described circumstances and a principal object of the present invention is to replace a constitution capable of suppressing a lowering in volume resistivity of a collect to be reused.

According to an aspect of the present invention, there is provided an image forming apparatus comprising: an image forming portion configured to form a toner image on a recording material with a liquid developer containing a toner and a carrier liquid, wherein the carrier liquid contains a first substance for imparting an electrical polarity to the toner and a second substance, higher in volume resistivity than the first substance, as a dispersion medium for dispersing the toner; and a carrier separating device configured to separate the carrier liquid into the first substance charged to an opposite polarity to a charge polarity of the toner and the second substance by applying an electric field to the liquid developer collected from the image forming portion so as to collect each of the first substance and the second substance.

According to another aspect of the present invention, there is provided a separating device comprising: a supplying portion configured to supply a liquid developer carrier tanking a toner, a first substance for imparting an electrical polarity to the toner and a second substance, higher in volume resistivity than the first substance, as a dispersion medium for dispersing the toner; a separating portion configured to separate the liquid developer into the first substance charged to an opposite polarity to a charge polarity of the toner and the second substance by applying an electric field to the liquid developer supplied to the supplying portion; and a collecting portion configured to collect each of the first substance and the second substance which are separated by the separating portion.

According to a further aspect of the present invention, there is provided an image forming apparatus comprising: a photosensitive member configured to form a latent image thereto; a developing device configured to develop the latent image, formed on the photosensitive member, into a toner image using a liquid developer containing a toner and a collect; a transfer device configured to transfer the toner image from the photosensitive member onto a recording material; a collecting device configured to collect the liquid developer remaining on the photosensitive member, wherein the carrier liquid contains a first substance for imparting an electrical polarity to the toner and a second substance, higher in volume resistivity than the first substance, as a dispersion medium for dispersing the toner; and a separating device configured to separate the carrier liquid into the first substance charged to an opposite polarity to a charge polarity of the toner and the second substance by applying an electric field to the liquid developer collected from the collecting device so as to collect each of the first substance and the second substance, wherein the second substance collected from the separating device is supplyable to the developing device.

Further features of the present invention will become apparent from the following description of exemplary embodiments with reference to the attached drawings.

DESCRIPTION OF EMBODIMENTS

First Embodiment

Figure 1:
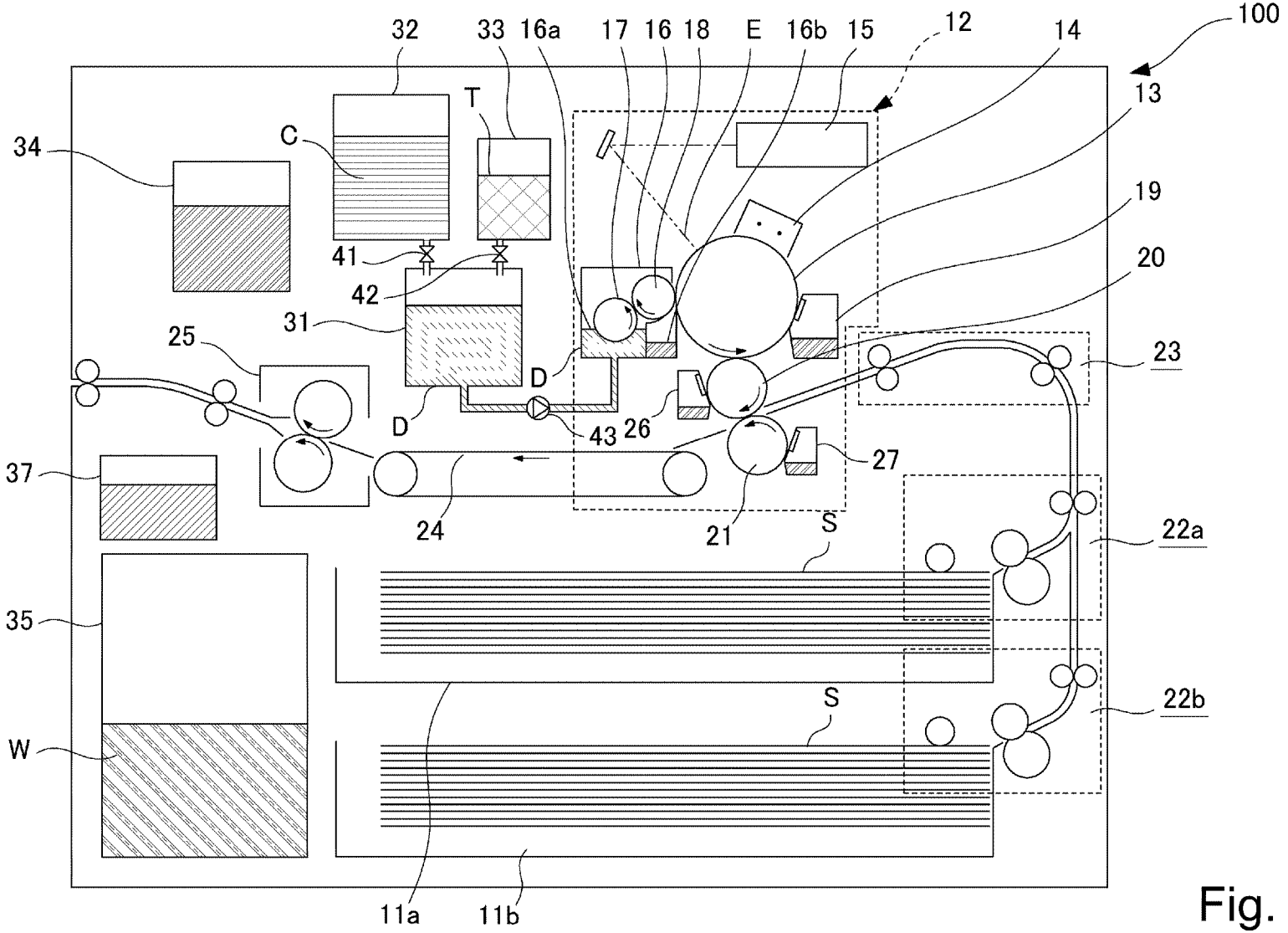
FIG. 1 is a schematic illustration of an image forming apparatus according to a First Embodiment of the present invention.

The First embodiment of the present invention will be described using FIGS. 1-14. First, a general structure of an image forming apparatus in this embodiment will be described using FIG. 1.

(Image Forming Apparatus)

An image forming apparatus 100 in this embodiment is a digital printer of an electrophotographic type in which a toner image is formed on a recording material (a sheet, a sheet material such as an OHP sheet and so on). The image forming apparatus 100 is operated on the basis of an image signal, and a toner image formed by an image forming portion 12 is transferred onto a sheet as the recording material is successively fed from each of cassettes 11*a*, 11*b* and then is fixed on the sheet S, so that an image is obtained. The image signal is sent from an external terminal such as an unshown scanner or an unshown personal computer.

The image forming portion 12 includes a photosensitive drum as an image bearing member, a charger 14, a laser exposure device 15, a developing device 16 and a drum cleaner 19. A surface of the photosensitive drum 13 electrically charged by the charger 14 is irradiated with laser light E from the laser exposure device 15 depending on the first signal, so that an electrostatic latent image is formed on the photosensitive drum 13. This electrostatic latent image is developed as a toner image by the developing device 16. In this embodiment, in the developing device 16, a liquid developer D as a liquid material in which a powdery toner which is a dispersoid is dispersed in a carrier liquid which is a dispersion medium is accommodated, and development is effected using this liquid developer D.

The liquid developer D is generated by mixing and dispersing a toner T in a carrier liquid C in a predetermined ratio in a mixer 31 as a mixing device, and then is supplied to the developing device 16. The carrier liquid C is accommodated in a carrier tank 32 as a carrier container (collecting container), and the toner T is accommodated in a toner tank 33 as a toner container. Then, depending on a mixed state of the carrier liquid C and the toner T in the mixer 31, the carrier liquid C or the toner T is supplied from an associated tank. In the mixer 31, a stirring blade driven by an unshown motor is accommodated, and the developer liquid D is mixed with the carrier liquid C or the toner T by being stirred, so that the toner is dispersed in the carrier liquid.

The liquid developer supplied from the mixer 31 to the developing device 16 is coated (supplied) on a developing roller 18 as a developer carrying member and is used for development. The developing roller 18 carries and feeds the liquid developer D on a surface thereof, and develops with the toner the electrostatic latent image formed on the photosensitive drum 13 (first bearing member). The carrier liquid C and the toner T which remain on the developing roller 18 after the development is collected in a collecting section 16*b* of the developing device 16. Here, each of coating of the liquid developer from a coating roller 17 onto the developing roller 18 and the development of the electrostatic latent image on the photosensitive drum 13 by the developing roller 18 is made using an electric field.

The toner image formed on the photosensitive drum 13 is transferred onto an intermediary transfer roller 20 using the electric field, and then is fed to a nip formed by the intermediary transfer roller 20 and a transfer roller 21. The toner T and the carrier liquid C which remain on the photosensitive drum 13 after the toner image transfer onto the intermediary transfer roller 20 are collected by the drum cleaner 19. Incidentally, at least one of the intermediary transfer roller 20 and the transfer roller 21 may also be an endless belt.

The sheet S accommodated in each of the cassettes 11*a*, 11*b* is fed toward a registration feeding portion 23 by an associated feeding portion 22*a* or 22*b* constituted by feeding rollers. The registration feeding portion 23 feeds the sheet S to the nip between the intermediary transfer roller 20 and the transfer roller 21 by being timed to the toner image transferred on the intermediary transfer roller 20.

In the nip between the intermediary transfer roller 20 and the transfer roller 21, the toner image is transferred onto the sheet S passing through the nip, and the sheet S on which the toner image is transferred is fed to a fixing device 25 by a feeding belt 24, so that the toner image transferred on the sheet S is fixed. The sheet S on which the toner image is fixed is discharged to an outside of the image forming apparatus, so that an image forming step is completed.

The intermediary transfer roller 20 and the transfer roller 21 are provided with an intermediary transfer roller cleaner 26 and a transfer roller cleaner 27, respectively, for collecting the toner T and the carrier liquid C which remain on the associated roller.

(Liquid Developer)

Next, the liquid developer D will be described. As the liquid developer D, a conventionally used liquid developer may also be used, but in this embodiment, an ultraviolet-curable liquid developer D is used and will be described below.

The liquid developer D is an ultraviolet-curable liquid developer which contains a cation-polymerizable liquid monomer, a photo-polymerization initiator and toner particles insoluble in the cation-polymerizable liquid monomer. The cation-polymerizable liquid monomer is vinyl ether compound, and the photo-polymerization initiator is a compound represented by the following formula (1).

formula (1)

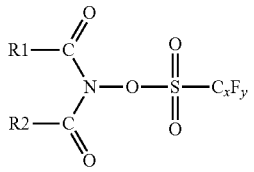

Specifically, first, the toner particles include a colorant and a toner resin material in which the colorant is incorporated. Together with the toner resin material and the colorant, another material such as a charge control agent may also be contained. As a manufacturing method of the toner particles, a well-known technique such as a coacervation in which the colorant is dispersed and a resin material is gradually polymerized so that the colorant is incorporated in the polymer or an internal pulverization method in which a resin material or the like is melted and the colorant is incorporated in the melted resin material may also be used. As the toner resin material, epoxy resin, styrene-acrylic resin or the like is used. The colorant may be a general-purpose organic or inorganic colorant. In the manufacturing method, in order to enhance a toner dispersing property, a dispersant is used but a synergist can also be used.

Next, a curable liquid which is the carrier liquid is constituted by the charge control agent for imparting electric charges to the toner surface, a photo-polymerization agent (initiator) for generating acid by ultraviolet (UV) irradiation and a monomer bondable by the acid. The monomer is a vinyl ether compound which is polymerizable by a cationic polymerization reaction. Separately from the photo-polymerization initiator, a sensitizer may also be contained. By photo-polymerization, a storage property lowers, and therefore a cationic polymerization inhibitor may also be added in an amount of 10-5000 ppm. In addition, a charge control aid, another additive or the like may also be used in some cases.

The UV curing agent (monomer) of the developer is a mixture of about 10% (weight %) of a monofunctional monomer having one vinyl ether group (formula 2 below) and about 90% (weight %) of difunctional monomer having two vinyl ether groups (formula 3 below).

formula 2

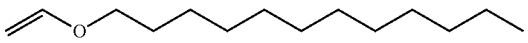

formula 3

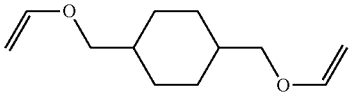

As the photo-polymerization initiator, 0.1% of a compound represented by formula 4 below is mixed. By using this photo-polymerization initiator, different from the case where an ionic photo-acid generator, a high-resistance liquid developer is obtained while enabling satisfactory fixing.

formula 4

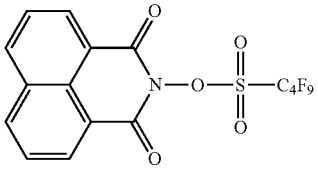

Incidentally, a cationic polymerizable liquid monomer may desirably be a compound selected from the group consisting of dichloropendadiene vinyl ether, cyclohexanedimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentylglycol divinyl ether, pentaerythritol tetravinyl ether, and 1,2-decanediol divinyl ether.

As the charge control agent, a well-known compound can be used. As a specific example, it is possible to use fats and oils such as linseed oil and soybean oil; alkyd resin; halogen polymer; oxidative condensates such as aromatic polycarboxylic acid, acidic group-containing water-soluble dye and aromatic polyamine; metallic soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexylate; sulfonic acid metal salts such as petroleum acid metal salt and metal salt of sulfosuccinic acid; phospholipid such as lectithin; salicylic acid metal salt such as t-butylsalicylic acid metal complex; polyvinyl pyrrolidone resin; polyamide resin; sulfonic acid-containing resin; and hydroxybenzoic acid derivative.

(Feeding of Liquid Developer)

Figure 2:
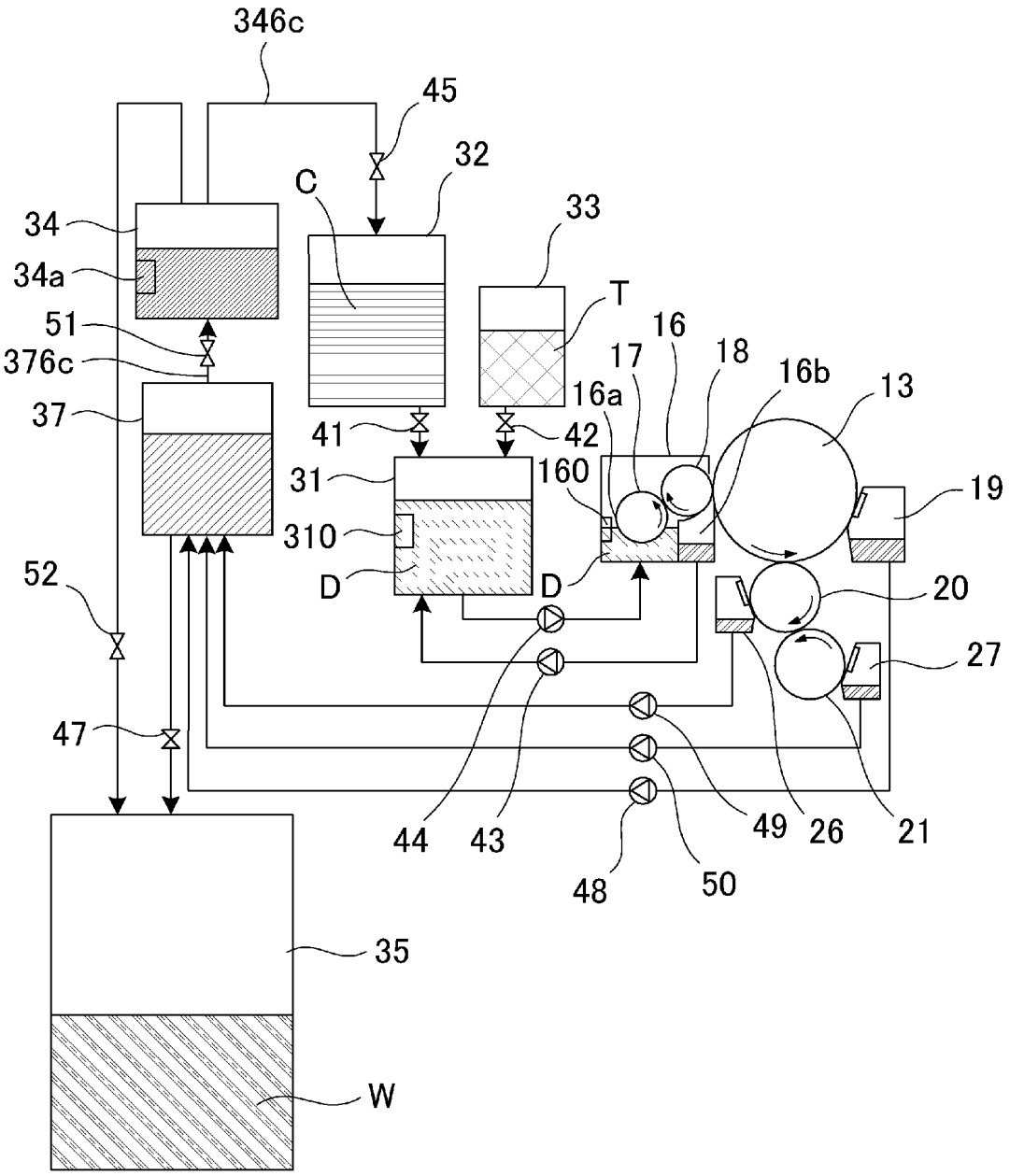
FIG. 2 is a schematic illustration showing a feeding path of a liquid developer in the image forming apparatus in the First Embodiment.

Next, feeding of the liquid developer D in this embodiment will be described using FIGS. 2 to 4. First, as described above, the developer collected at the image forming portion 12 including the drum cleaner 19, the intermediary transfer roller cleaner 26 and the transfer roller cleaner 27 is sent to a first separation and extraction device (first separating device) 37 and a second separation and extraction device (second separating device) 34. Incidentally, the developer which remains on the developing roller 18 after development and which is collected into the collecting section **16*b* of the developing device is returned to the mixer 31, but may also be fed to the first and second separation and extraction devices 37, 34**.

Although details will be described later, the first separation and extraction device 37 separates a reusable carrier liquid and a waste liquid W containing the toner and an impurity such as paper powder when the carrier liquid and the toner are separated from each other, so that the separated waste liquid W is collected in a waste liquid collecting container 35.

Although details will be described later, the second separation and extraction device 34 separates the carrier liquid, separated and extracted by the first separation and extraction device 37, into a first substance having an opposite polarity to a charge polarity of the toner and a second substance having an intermediary charge amount between those of the toner and the first substance. The waste liquid W containing the first substance separated from the second substance and the impurity is collected in the waste liquid collecting container.

Here, as the first substance, for example, a substance (low-resistance carrier) which is contained in the carrier liquid and which has a low volume resistivity is used. As described above, in the substances forming the carrier liquid, the charge control agent is contained, so that the first substance in this embodiment is principally the charge control agent. On the other hand, the second substance is a substance other than the charge control agent and is a substance (high-resistance carrier) having a volume resistivity higher than the volume resistivity of the charge control agent. The volume resistivity of the second substance from which the first substance is separated is $1.0\times10^{12}$ Ω·cm, and the volume resistivity of the first substance is, for example, $1.0\times10^{9}$ Ω·cm.

In the case where an electric field is applied to the liquid developer containing the toner and the carrier liquid, for example, the toner has a negative charge amount (e.g., −4 μC), the first substance has a positive charge amount (e.g., +3 μC), and the first substance has a charge amount of substantially 0 (e.g., ±0 μC). That is, the first substance has the charge amount of the opposite polarity to the toner charge polarity, and the second substance has the intermediary charge amount between the charge amounts of the toner and the first substance. Here, the intermediary charge amount refers to the charge amount between a maximum (+3 in this embodiment) of the charge amount and a minimum (−4 in this embodiment) of the charge amount also in consideration of a sign (+ or −) of the charge polarity. In this embodiment, although details will be described later, using a difference in such a charge amount, each of the toner, the first substance and the second substance is separated and extracted.

Specifically, feeding of the liquid developer will be described. A transporting pipe from the carrier tank 32 to the mixer 31 and a transporting pipe from the toner tank 33 to the mixer 31 are provided with electromagnetic valves 41 and 42, respectively, and a supply amount of the carrier liquid C to the mixer 31 and a supply amount of the toner T to the mixer 31 are adjusted. From the mixer 31, the liquid developer D necessary for the development is supplied using a pump 44 as a liquid developer supplying means.

The developer collected in the collecting container 16*b* of the developing device 16 is returned to the mixer 31 by a pump 43. This is because the developer collected in the collecting container 16*b* is little used for the development or the like and therefore is little deteriorated.

The residual carrier liquid and the residual toner which are collected by the drum cleaner 19, the intermediary transfer roller cleaner 26 and the transfer roller cleaner 27 are fed to the first separation and extraction device 37 by pumps 48, 49 and 50, respectively. The liquid developer (carrier liquid) separated and extracted by the first separation and extraction device 37 is sent to the second separation and extraction device 34 by an electromagnetic valve 51.

The reusable carrier liquid separated by the first and second separation and extraction devices 37, 34 is fed to the carrier tank 32 by an electromagnetic valve 45. On the other hand, the waste liquid separated by the separation and extraction device 34 is appropriately fed to the waste liquid collecting container 35 by an electromagnetic valve 47 provided to a transporting pipe through self-weight fall.

Figure 3:
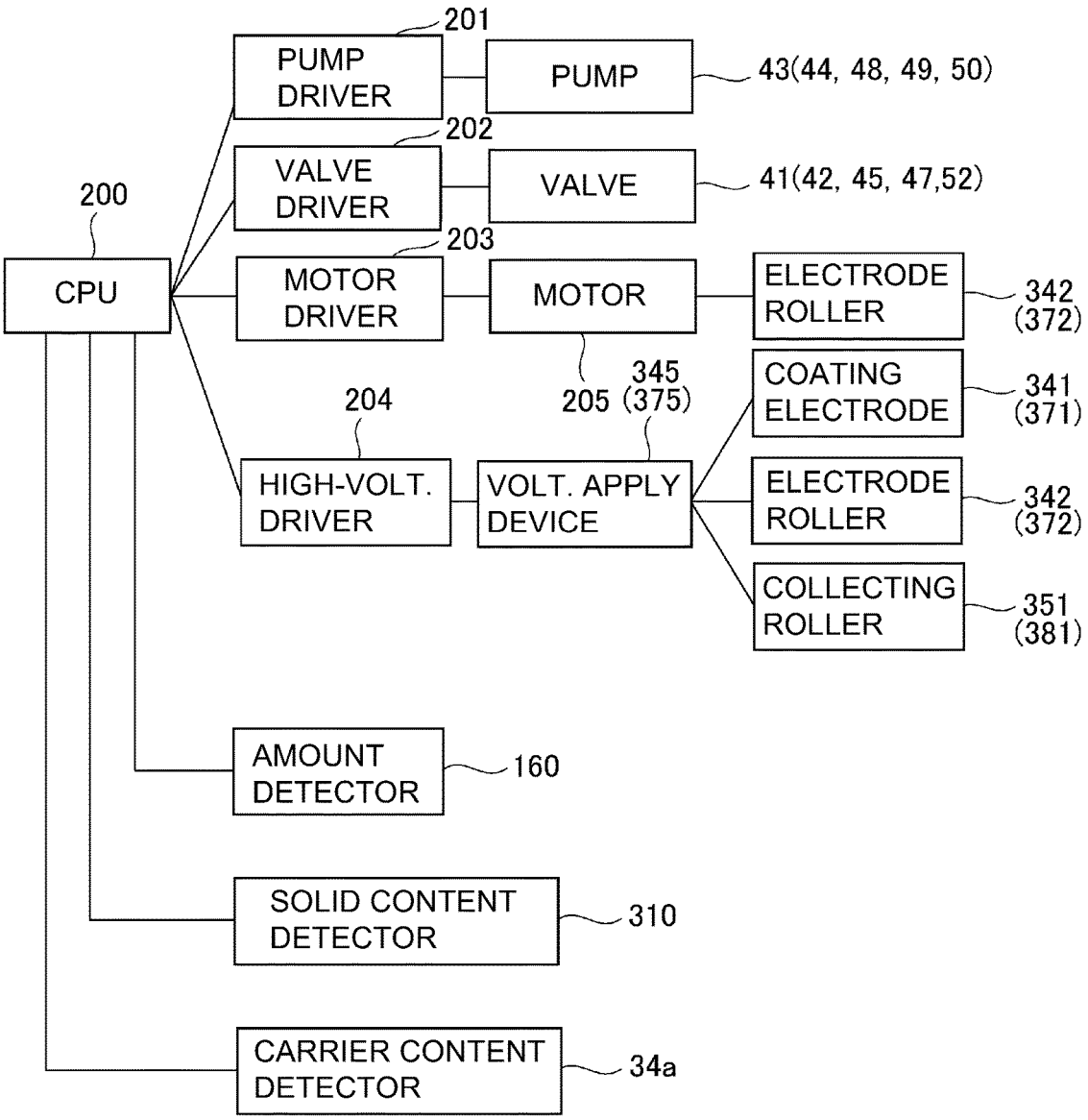
FIG. 3 is a control block diagram of a feeding operation of the liquid developer in the image forming apparatus in the First Embodiment.

As shown in FIG. 3, the above-described pumps 43, 44, 48, 49, 50 and electromagnetic valves 41, 42, 45, 47, 52 are controlled by a CPU 200 as a controller through a pump driver 201 and an electromagnetic valve driver 202, respectively. The CPU 200 controls the respective pumps and the like on the basis of detection values of a developer amount detecting device 160, a solid component content detecting device 310 and a carrier liquid resistance detecting device 34*a*.

A feeding operation of the liquid developer will be described using FIG. 4 while making reference to FIGS. 2 and 3. First, as shown in FIGS. 2 and 3, the developing device 16 is provided with the developer amount detecting device 160, so that an amount of the liquid developer in the developing device 16 is detected by the developer amount detecting device 160. Further, the mixer 31 is provided with the solid component content detecting device 310, so that a content of a solid component such as the toner in the mixer 31 is detected. The solid component content detecting device 310 is, for example, provided with a light-emitting portion and a light-receiving portion, and a portion where the liquid in the mixer 31 passes is irradiated with light from the light-emitting portion and then the light passing through the portion is received by the light-receiving portion. Depending on the amount of the solid component at this portion, a light quantity of the light received by the light-receiving portion changes, and therefore depending on the change in light quantity, the content of the solid component in the mixer 31 can be detected.

Figure 4:
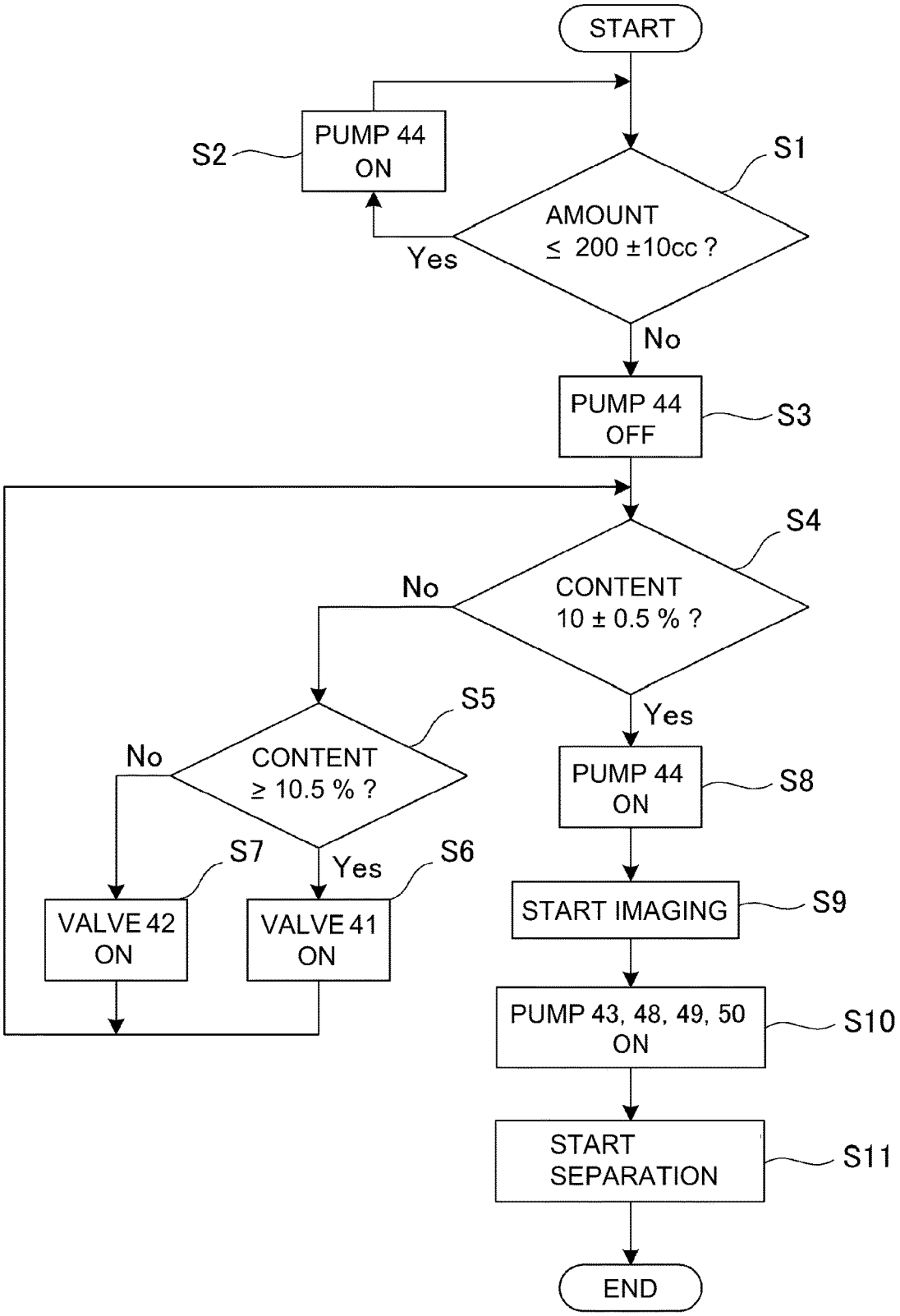
FIG. 4 is a flowchart showing control of the feeding operation of the liquid developer in the image forming apparatus in the First Embodiment.

As shown in FIG. 4, a developer amount in the developing device 16 is detected by the developer amount detecting device 160 (S1). Then, in the case where the developer amount in the developing device 16 is not more than a predetermined amount (e.g., 200±10 cc), the CPU 200 drives the pump 44 (S2), so that adjustment of the liquid developer amount in the developing device 16 is made. After the adjustment, the drive of the pump 44 is stopped (S3).

Then, the content of the solid component in the mixer 31 is detected by the solid component content detecting device 310 (S4). In the case where the content of the solid component in the mixer 31 is out of a predetermined range (e.g., 10±0.5%), the CPU 200 discriminates whether or not the solid component content is 10.5% or more (S5). In the case where the solid component content is 10.5% or more, the electromagnetic valve 41 is opened, so that the carrier liquid is supplied from the carrier tank 32 into the mixer 31 (S6). On the other hand, in the case where the solid component content is not 10.5% or more, i.e., in the case where the solid component content is 9.5% or less, the electromagnetic valve 42 is opened, so that the toner is supplied from the toner tank 33 into the mixer 31 (S7). As a result, content adjustment of the liquid developer in the mixer 31 is made.

That is, in the case where a toner content (solid component content) is high, the carrier liquid is supplied from the carrier tank 32 to the mixer 31 through the electromagnetic valve 41. Further, in the case where the toner content is low, the liquid developer higher in toner content than the liquid developer used in the mixer 31 is supplied from the toner tank 33 to the mixer 31 through the electromagnetic valve 42.

When the solid component content in the mixer 31 falls within the predetermined range, the pump 44 is driven as desired, and then the liquid developer subjected to the content adjustment is supplied from the mixer 31 to the developing device 16 (S8). Then, image formation is started (S9), and at the same time, drive of the pumps 43, 48, 49, 50 is also started (S10), and also drive of the separation and extraction device 34 is started (S11).

(Second Separation and Extraction Device)

The first separation and extraction device 37 and the second separation and extraction device 34 have the same constitution. Accordingly, in the following description, the second separation and extraction device 37 as the separating device will be described using FIGS. 5 to 11, and as regards the first separation and extraction device 34, the same constitution is represented by an associated reference numeral or symbol in parentheses and a portion different in action (function) from an associated portion will be described supplementarily.

First, the first separation and extraction device 34 is a device for separating the liquid developer into the toner and the carrier liquid using the electric field and for separately extracting the carrier liquid and the toner. The second separation and extraction device 34 is, as described above, a device for separating and extracting the low-resistance carrier (principally the charge control agent) as the first substance from the carrier liquid separated and extracted by the first separation and extraction device 37, by using the electric field.

The reason why the second separation and extraction device 34 is provided will be described. The carrier liquid is repetitively subjected to recycling, so that the substance (low-resistance carrier) having the low volume resistivity accumulates in the carrier liquid. Thus, the resistance of the entirety of the liquid developer lowers, so that there is a liability that the image defect generates. Particularly, in the case where a high-density image such as a solid image (which is a toner image formed on an entire surface of an image formable region of the photosensitive drum and which refers to the case where an image ratio (print ratio is 100%), a proportion of the carrier liquid in an output image is small, and therefore particularly the resistance is liable to lower. In this embodiment, in order to suppress such a lowering in volume resistivity of the carrier liquid, the second separation and extraction device 34 is provided.

Figure 5:
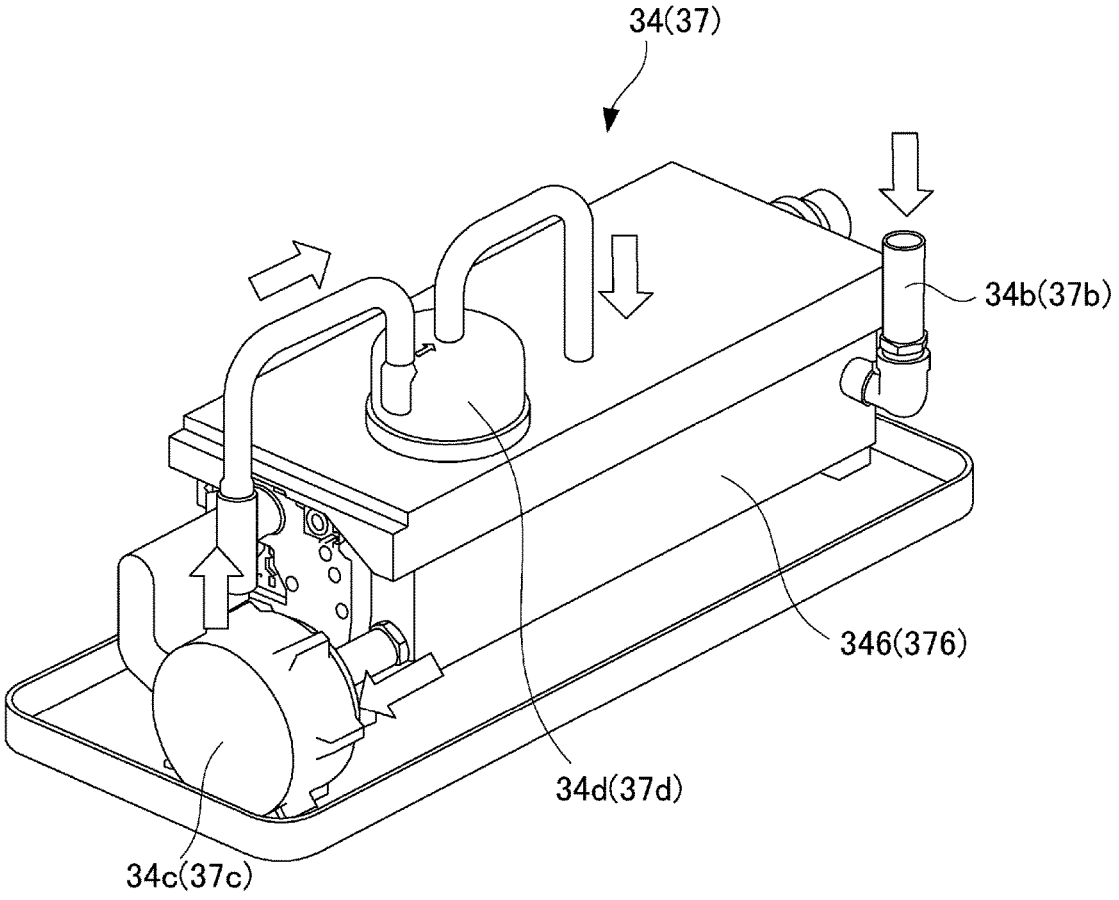
FIG. 5 is a perspective view of a separation and extraction device in the First Embodiment.
Figure 6:
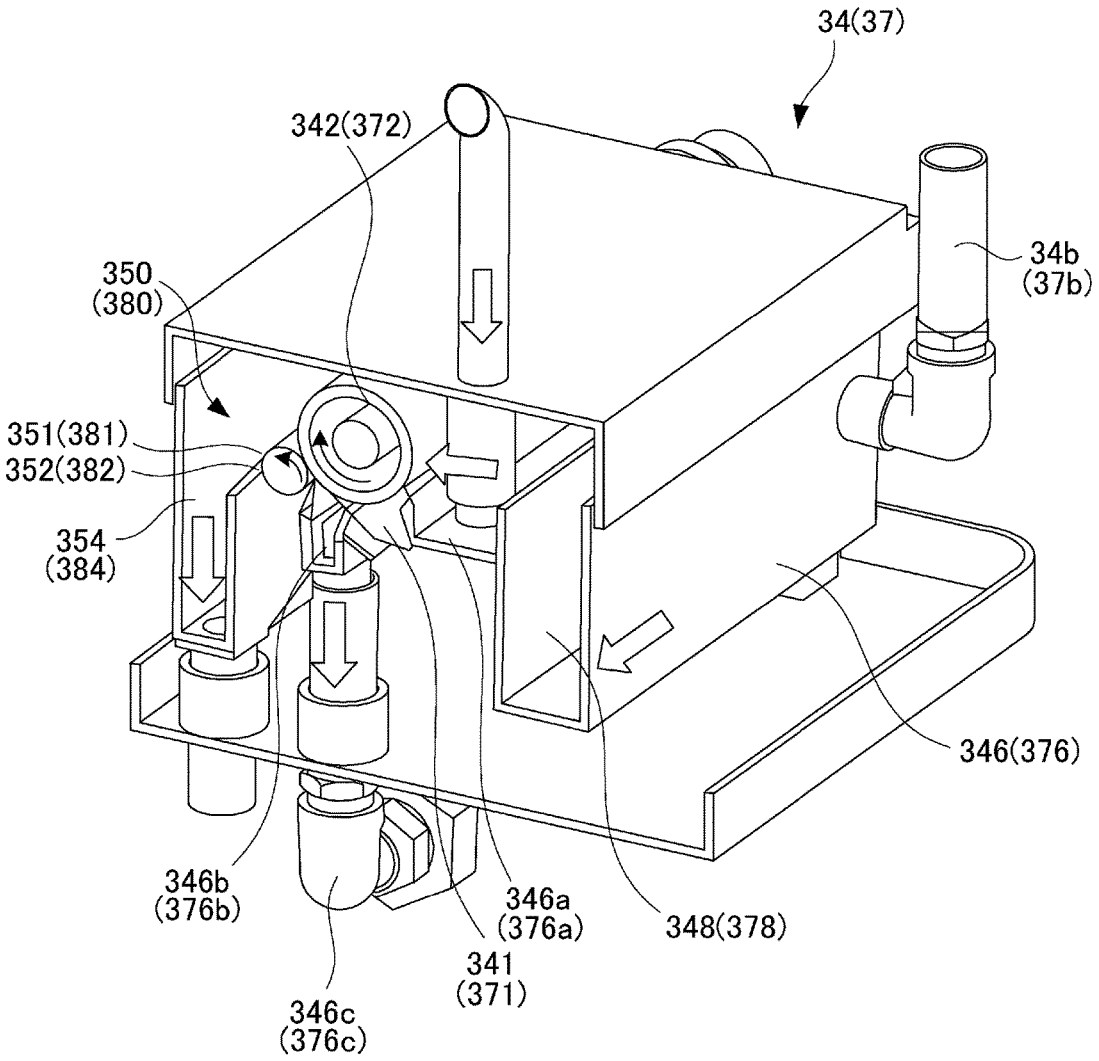
FIG. 6 is a partially cut perspective view showing the separation and extraction device in the First Embodiment.

The carrier liquid (liquid developer) separated by the first separation and extraction device 37 is fed from an inlet 34*b* of the separation and extraction device 34 into a liquid accommodating container 346 as show by arrows in FIGS. 5 and 6. Then, the liquid developer is supplied to a buffer container 348 in the liquid accommodating container 346. In this embodiment, the buffer container 348 is provided in the second separation and extraction device 34, but may also be provided separately as a single member. The collect carrier liquid supplied to the buffer container 348 is fed by a pump 34*c* and passes through a filter 34*d*.

The carrier liquid passed through the filter 34*d* is poured on a supply tray 346*a* as a supplying portion as shown in FIG. 6. Incidentally, in the second separation and extraction device 34, the filter 34*d* may also be omitted, so that the carrier liquid separated and extracted by the first separation and extraction device 37 may be directly poured on the supply tray 346*a*. As described later specifically, the carrier liquid poured on the supply tray 346*a* is separated into the low-resistance carrier (first substance, charge control agent) and the high-resistance carrier (second substance) by the second separation and extraction device 34. Then, the extracted low-resistance carrier is sent to the waste liquid collecting container 35, and the extracted high-resistance carrier (carrier liquid) is fed to the carrier tank 32.

Figure 7:
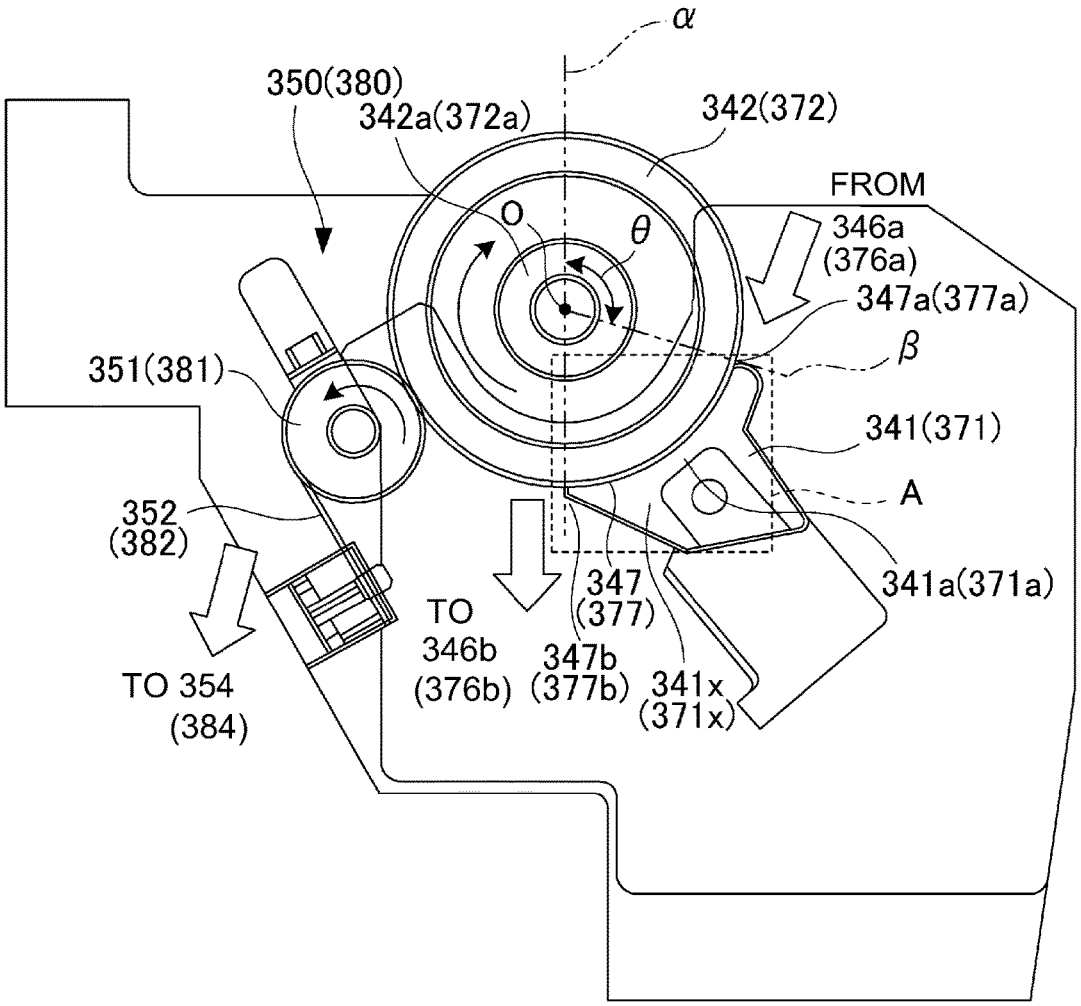
FIG. 7 is a sectional view showing a part of the separation and extraction device in the First Embodiment.

Next, a constitution of separation and extraction of the low-resistance carrier and the high-resistance carrier in the second separation and extraction device 34 will be described. As shown in FIGS. 6 and 7, in the liquid accommodating container 346, a coating electrode member 341 as a second external electrode member, an electrode roller 342 as an electroconductive second roller, a collecting device 350 and the like are provided. A pair of second electrodes, between which the liquid developer is passable, is constituted by the coating electrode member 341 and the electrode roller 342, and the electrode roller 342 includes a second electrode 342*a* as one of the second electrodes, and the coating electrode member 341 includes a second electrode 341*a* as the other second electrode. The liquid accommodating container 346 is a container capable of accommodating the carrier liquid and includes the above-described supply tray 346*a*, a discharge portion 346*b* as a second discharge portion through which a reusable carrier liquid is to be discharged as described later, and a collecting portion 354 for collecting the developer which is the waste liquid.

The electrode roller 342 is an electroconductive roller which is, for example, formed by integrally molding a core metal, formed with a solid stainless steel material in an outer diameter of 40 mm, with a urethane rubber elastic layer formed on a surface of the core metal. As shown in FIG. 3, a driving force is externally inputted into the electrode roller 342 by a driving motor 205, so that the electrode roller 342 is rotated in a predetermined direction (arrow directions of FIGS. 6 and 7). In this embodiment, a rotational speed of the driving motor 205 is 2000 rpm. Then, the electrode roller 342 is rotated at a rotational speed of, e.g., 400 rpm by reducing the rotational speed of the driving motor 205 by a speed reducer. Incidentally, a voltage applying device 345 is controlled by the CPU 200 through a high-voltage driver 204, and the driving motor 205 is controlled by the CPU 200 through a motor driver 203.

Figure 8:
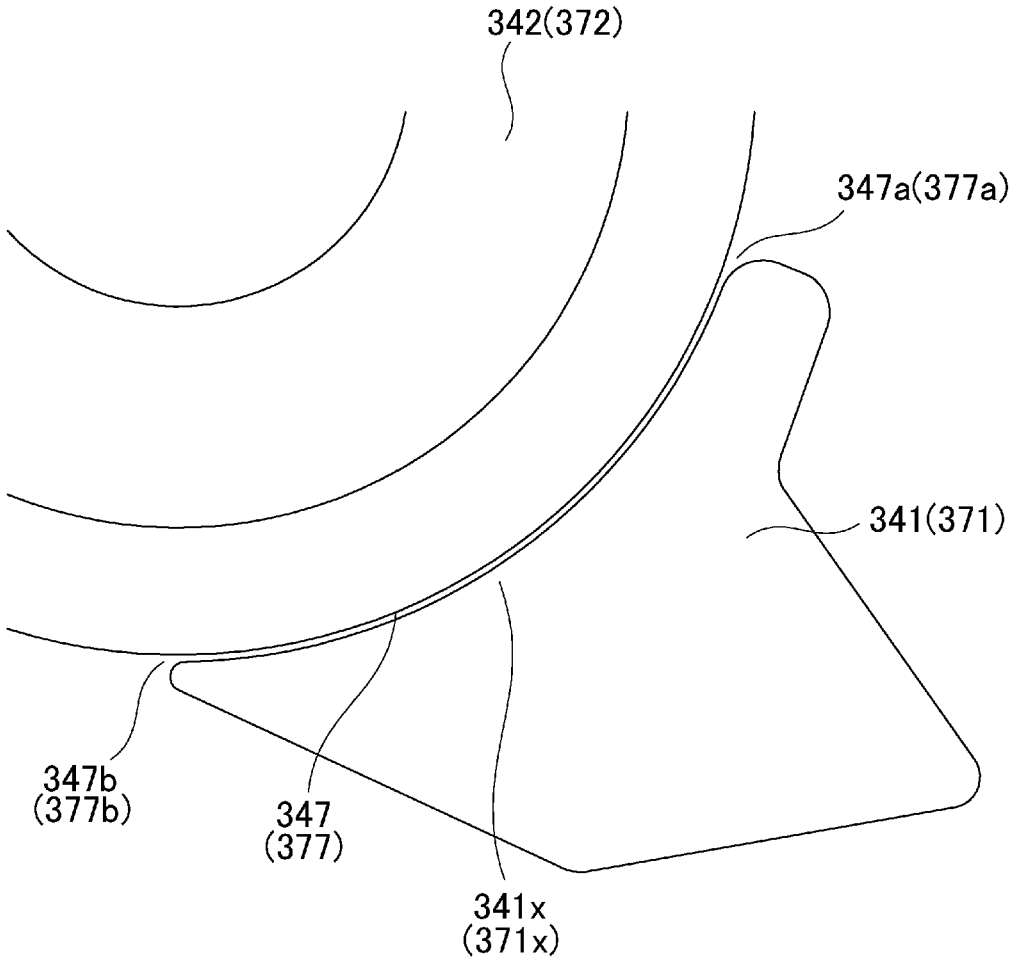

The coating electrode member 341 is disposed with a gap 347 as a second gap with a part of the electrode roller 342 as shown in FIGS. 7 and 8. With an upstream end portion 347*a* of the gap 347 with respect to a rotational direction of the electrode roller 342, the supply tray 346*a* is connected. Further, the carrier liquid poured in the supply tray 346*a* as described above is supplied into the gap 347 through the upstream end portion 347*a*. The gap 347 is sealed at both end portions thereof with respect to a rotational axis direction of the electrode roller 342, so that the carrier liquid supplied into the gap 347 is fed through the gap 347 toward a downstream side of the gap 347 with respect to the rotational direction of the electrode roller 342 with rotation of the electrode roller 342. With a downstream end portion 347*a* of the gap 347 with respect to the rotational direction of the electrode roller 342, the discharge portion 346*b* is connected (FIG. 6). Further, the carrier liquid passed through the gap 347 is sent to the carrier tank 32 through the discharge portion 346*b* via a transporting pipe 346*c* (FIGS. 2 and 6).

Incidentally, the transporting pipe 346*c* is connected with also a path through which the discharged carrier liquid is returned to the separation and extraction device 34 again. The discharge portion 346*b* is provided with the carrier liquid resistance detecting device 34*a*, so that the volume resistivity of the carrier liquid sent into the discharge portion 346*b* is detected. The carrier liquid resistance detecting device 34*a* detects the volume resistivity of the carrier liquid by detecting the resistance of the carrier liquid when a current is caused to flow through a pair of electrodes provided in the carrier liquid. Further, in the case where the volume resistivity of the carrier liquid sent to the discharge portion 346*b* is less than a predetermined value (e.g., $1.0\times10^{11}$ Ω·cm), the carrier liquid is returned to the second separation and extraction device 34 again, so that the separation of the carrier liquid into the low-resistance carrier and the high-resistance carrier is effected.

This is because, for example, the case where an abnormal situation such that a power source is shut down during an operation of the second separation and extraction device 34 generates and thus the low-resistance carrier and the high-resistance carrier cannot be sufficiently separated from each other by the second separation and extraction device 34 is assumed. In such a case, the volume resistivity of the carrier liquid sent to the discharge portion 346*b* is less than the predetermined value, and therefore in this case, the carrier liquid is returned to the second separation and extraction device 34. Ordinarily, as described later, the carrier liquid passes through the gap 347, so that the low-resistance carrier and the high-resistance carrier are separated from each other and then the extracted high-resistance carrier is sent to the discharge portion 346*b*. Accordingly, the volume resistivity of the carrier liquid sent to the discharge portion 346*b* is not less than the predetermined value, so that the carrier liquid is sent to the carrier tank 32 without being returned to the second separation and extraction device 34. Incidentally, such a path for returning the carrier liquid to the second separation and extraction device 34 may also be omitted.

As described above, the coating electrode member 341 disposed opposite to the electrode roller 342 with the gap 347 is formed of an electroconductive material at least at a surface of a portion 341*x* on which the liquid passes through the gap 347. The coating electrode member 341 is formed of, e.g., a solid stainless steel material in width of 400 mm. The portion 341*x* on which the liquid passes has a shape of accommodating a part of the electrode roller 342, and an opposing surface of the portion 341*x* to the electrode roller 342 has a curved shape such that a predetermined distance (i.e., the gap 347) is maintained between the opposing surface and the surface of the electrode roller 342. This predetermined distance is, e.g., 0.2 mm.

As shown in FIG. 3, with the coating electrode member 341 and the electrode roller 342, the voltage applying device 345 as a second voltage applying means is connected. Further, between the coating electrode member 341 and the electrode roller 342, a voltage is applied by the voltage applying device 345 so that an electric field moves the low-resistance carrier (first substance, charge control agent) toward the electrode roller 342 side (side of one of the second electrodes). That is, to the gap 347, a voltage such that an electric field for attracting the low-resistance carrier to the electrode roller 342 is generated is applied.

In this embodiment, the charge control agent is positively charged, and therefore for example, a voltage of −300 V is applied to the electrode roller 342, and a voltage of −200 V is applied to the coating electrode member 341. Thus, the low-resistance carrier in the carrier liquid passing through the gap 347 is moved from the coating electrode member 341 to the electrode roller 342. As a result, during the passing of the carrier liquid through the gap 347, the low-resistance carrier is carried on the electrode roller 342, so that the low-resistance carrier and the high-resistance carrier are separated from each other. The separated high-resistance carrier (carrier liquid) is discharged to the discharge portion 346*b* connected with the downstream end portion 347*b* of the gap 347, and then is sent to the carrier tank 32 as a collecting container as described above.

The collecting device 350 is positioned downstream of the coating electrode member 341 with respect to the rotational direction of the electrode roller 342, and collects the low-resistance carrier carried on the electrode roller 342. The collecting device 350 includes collecting roller 351, the voltage applying device 345 as a collecting voltage applying means, and a blade member 352 as a scraping member.

The collecting roller 351 is an electroconductive roller formed of, e.g., a solid stainless steel material in an outer diameter of 20 mm, and is provided in contact with the electrode roller 342. Further, the collecting roller 351 contacts the electrode roller 342 and is rotated by the electrode roller 342 in arrow directions of FIGS. 6 and 7. Incidentally, a rotational speed of the collecting roller 351 is, e.g., 800 rpm.

Figure 9:
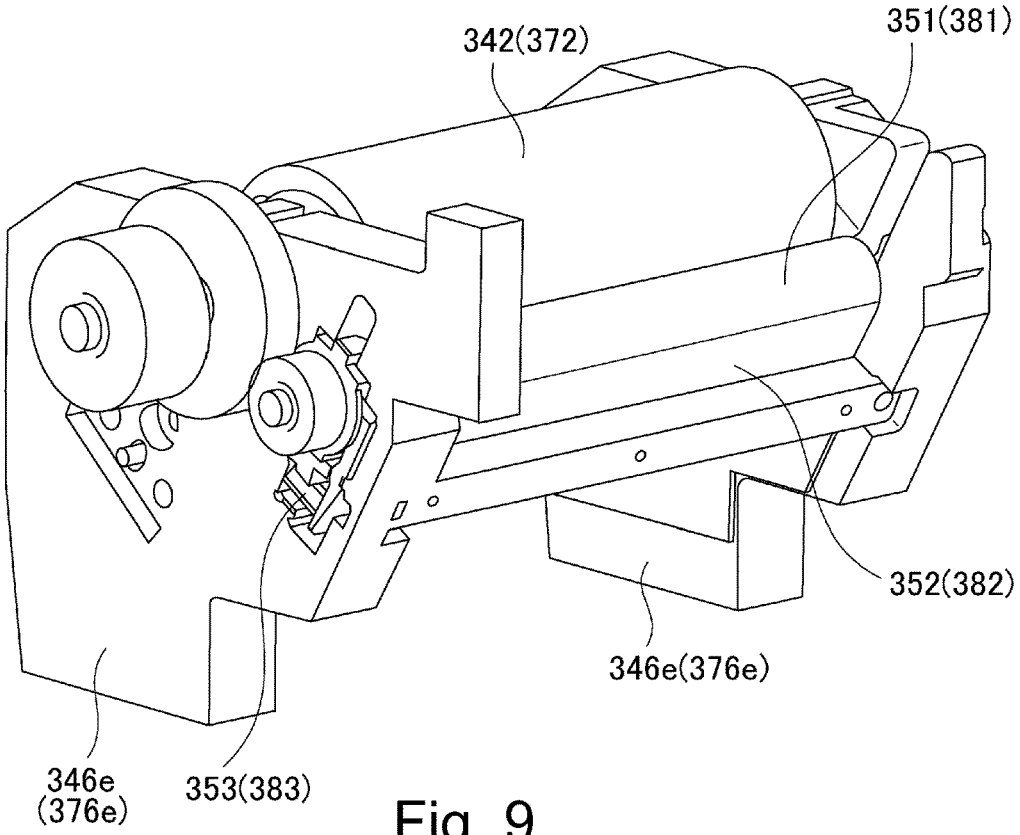
FIG. 9 is a perspective view showing a part of the separation and extraction device in the First Embodiment.
Figure 10:
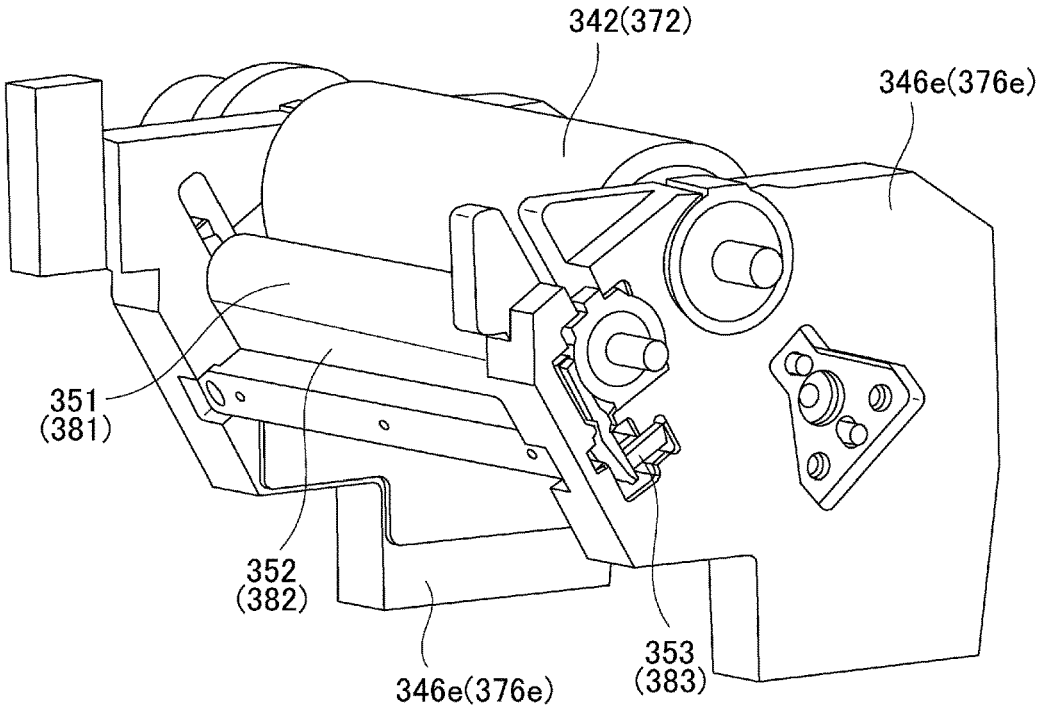
FIG. 10 is a perspective view showing the part of the separation and extraction device in the First Embodiment as seen from an angle different from an angle in FIG. 9.

As shown in FIGS. 9 and 10, the electrode roller 342 and the collecting roller 351 are disposed in substantially parallel to each other, and both end portions of these rollers 342 and 351 with respect to a rotational axis direction are rotatably supported by frames 346*e* constituting the liquid accommodating container 346. At both end portions of the collecting roller 351, urging mechanisms 353 such as springs are provided. The collecting roller 351 is urged toward the electrode roller 342 by the urging mechanisms 353, so that the electrode roller 342 is elastically deformed. An urging force for urging the collecting roller 351 toward the electrode roller 342 by the urging mechanisms 353 is, e.g., 3 kgf (29.4 N).

The coating electrode member 341 and the collecting roller 351 are positioned on the basis of the electrode roller 342, so that the electrode roller 342 is a positional basis for these members 341 and 351.

The voltage applying device 345 is connected with the electrode roller 342 and the collecting roller 351 as shown in FIG. 3, and applies a voltage between the collecting roller 351 and the electrode roller 342 so that an electric field for moving the toner toward the collecting roller 351 is generated. In this embodiment, the voltage applying device connected with the electrode roller 342 and the collecting roller 351 and the voltage applying device connected with the electrode roller 342 and the coating electrode member 341 are used in common, but may also be separately provided. In this embodiment, for example, a voltage of −300 V is applied to the electrode roller 342, and a voltage of −400 V is applied to the collecting roller 351. Thus, the low-resistance carrier which is carried on the electrode roller 342 and which is fed toward the collecting roller 351 is moved from the electrode roller 342 to the collecting roller 351.

The blade member 352 solid components off the low-resistance carrier on the collecting roller 351 in contact with the collecting roller 351. The blade member 352 is disposed at a position downstream of a position of contact between the electrode roller 342 and the collecting roller 351 with respect to a rotational direction of the collecting roller 351 so that the blade member 352 contacts the collecting roller 351 with respect to a counter direction to the rotational direction of the collecting roller 351. Incidentally, the counter direction is a direction such that a direction in which the free end portion 352*a* contacting the surface of the collecting roller 351 extends is opposite to a tangential direction along the rotational direction of the collecting roller 351. Further, the blade member 352 is a plate(-like) member extending along a longitudinal direction (rotational axis direction) of the collecting roller 351 and for example, a stainless steel material is used as a material of the collecting roller 351.

As described above, the low-resistance carrier moved from the electrode roller 342 to the collecting roller 351 is scraped off by the blade member 352 and then is sent to the collecting portion 354. The low-resistance carrier collected in the collecting portion 354 is sent to the waste liquid collecting container 35 as described above. Incidentally, a scraping member for scraping the low-resistance carrier off the collecting roller 351 is not limited to the blade member. For example, the blade member may also be formed in a brush shape other than the blade shape.

(Positional Relation Between End Portions of Gap)

In the case of this embodiment, as described above, the carrier liquid which is collected at the image forming portion 12 and which is supplied from the supply tray 346*a* to the gap 347 passes through the gap 347, so that the liquid developer is separated into the low-resistance carrier and the high-resistance carrier. Here, the liquid flows from above to below along a direction of gravitation.

Therefore, in this embodiment, as shown in FIG. 7, in the case where a line α passing through a center O of the electrode roller 342 and a top of the electrode roller 342 with respect to the direction of gravitation is 0°, the upstream end portion 347*a* of the gap 347 is positioned in a range of 0° or more and less than 180° with respect to the rotational direction of the electrode roller 342. In other words, an angle formed between the line α and a line β passing through the upstream end portion 347*a* of the gap 347 and the center O is θ, the upstream end portion 347*a* is positioned so that the angle θ is 0° or more and less than 180°. In a preferred example, the upstream end portion 347*a* of the gap 347 is positioned in a range of 60° or more and 120° or less with respect to the rotational direction of the electrode roller 342. In this embodiment, the upstream end portion 347*a* is positioned in a range from 90° to 120° with respect to the rotational direction of the electrode roller 342.

The downstream end portion 347*b* of the gap 347 is positioned below the upstream end portion 347*a* with respect to the direction of gravitation. In a preferred example, the downstream end portion 347*b* of the gap 347 is positioned in a range of 180° or less with respect to the rotational direction of the electrode roller 342. That is, it is preferable that the downstream end portion 347*b* is positioned in a range which includes the position of 180° and in which the downstream end portion 347*b* is positioned upstream of the position of 180° with respect to the rotational direction of the electrode roller 342. As a result, the liquid developer passing through the gap 347 is prevented from being fed against gravitation, so that the reuse efficiency can be further enhanced. In this embodiment, the downstream end portion 347*b* is in the position of 180° with respect to the rotational direction of the electrode roller 342.

Incidentally, a length of the gap 347, i.e., a length from the upstream end portion 347*a* to the downstream end portion 347*b* along the electrode roller 342 may preferably be not less than ⅕ of a peripheral length of an outer peripheral surface of the electrode roller 342. This length of the gap 347 may also be set depending on the rotational speed of the electrode roller 342. For example, in the case where the rotational speed of the electrode roller 342 is slow, the length of the gap 347 can be shortened. In summary, it is only required that a length in which the low-resistance carrier and the high-resistance carrier are separated from each other is ensured during the passing of the liquid developer through the gap 347.

[Supplemental Description of First Separation and Extraction Device)

As described above, the liquid developer collected by the image forming portion 12 such as the drum cleaner 19 is fed from an inlet 37*b* of the first separation and extraction device 37 into a liquid accommodating container 376 as shown by arrows in FIGS. 5 and 6. Then, the liquid developer is supplied to a buffer container 378 in the liquid accommodating container 376. The liquid developer supplied to the buffer container 378 is fed by a pump 37*c* and passes through a filter 37*d*.

The liquid developer passed through the filter 37*d* is poured on a supply tray 376*a* as a supplying portion as shown in FIG. 6. As described later specifically, the liquid developer poured on the supply tray 376*a* is separated into the toner and the carrier liquid by the first separation and extraction device 37. Then, the extracted toner is sent to the waste liquid collecting container 35, and the extracted carrier liquid is fed to the second separation and extraction device 34 as described above.

As shown in FIGS. 6 and 7, in the liquid accommodating container 376, a coating electrode member 371 as a first external electrode member, an electrode roller 372 as an electroconductive first roller, a toner collecting device 380 and the like are provided. A pair of first electrodes, between which the liquid developer is passable, is constituted by the coating electrode member 371 and the electrode roller 372, and the electrode roller 372 includes a first electrode 372*a* as one of the second electrodes, and the coating electrode member 371 includes a first electrode 371*a* as the other second electrode. The liquid accommodating container 376 is a container capable of accommodating the liquid developer and includes the above-described supply tray 376*a*, a discharge portion 376*b* as a first discharge portion through which the carrier liquid is to be discharged, and a collecting portion 384 for collecting the developer which is the waste liquid.

As shown in FIG. 3, a driving force is externally inputted into the electrode roller 372 by a driving motor 205, so that the electrode roller 342 is rotated in a predetermined direction (arrow directions of FIGS. 6 and 7). In this embodiment, a rotational speed of the driving motor 205 is 2000 rpm. Incidentally, the driving motor 205 for driving the electrode roller 342 of the second separation and extraction device 34 and the electrode roller 372 of the first separation and extraction device 37 may be the same or may also be separately provided for each of the electrode rollers 342, 372.

The coating electrode member 371 is disposed with a gap 377 as a first gap with a part of the electrode roller 372 as shown in FIGS. 7 and 8. With an upstream end portion 377*a* of the gap 377 with respect to a rotational direction of the electrode roller 372, the supply tray 376*a* is connected. Further, the liquid developer poured in the supply tray 376*a* as described above is supplied into the gap 377 through the upstream end portion 377*a*. The liquid developer supplied into the gap 377 is fed through the gap 377 toward a downstream side of the gap 377 with respect to the rotational direction of the electrode roller 372 with rotation of the end portion 372. With a downstream end portion 377*a* of the gap 377 with respect to the rotational direction of the electrode roller 372, the discharge portion 376*b* is connected (FIG. 6). Further, the liquid developer passed through the gap 377 is sent to the second separation and extraction device 34 through the discharge portion 376*b* via a transporting pipe 376*c* (FIGS. 2 and 6).

Incidentally, the transporting pipe 376*c* is connected with also a path through which the discharged liquid developer is returned to the separation and extraction device 34 again. The discharge portion 376*b* is provided with an unshown carrier liquid content detecting device, so that the toner content in the liquid developer sent into the discharge portion 376*b* is detected. Further, in the case where the toner content of the liquid developer sent to the discharge portion 376*b* is larger than a predetermined value (e.g., 0.02%), the liquid developer is returned to the first separation and extraction device 37 again, so that the separation of the liquid developer into the toner and the carrier liquid is effected. This is because, for example, the case where an abnormal situation such that a power source is shut down during an operation of the first separation and extraction device 37 generates and thus the carrier liquid and the toner cannot be sufficiently separated from each other by the second separation and extraction device 34 is assumed.

As described above, the coating electrode member 371 disposed opposite to the electrode roller 372 with the gap 377 is formed of an electroconductive material at least at a surface of a portion 371*x* on which the liquid passes through the gap 377. As shown in FIG. 3, with the coating electrode member 371 and the electrode roller 372, the voltage applying device 375 as a first voltage applying means is connected. Further, between the coating electrode member 371 and the electrode roller 372, a voltage is applied by the voltage applying device 375 so that an electric field moves the toner toward the electrode roller 372 side (side of one of the first electrodes). That is, to the gap 377, a voltage such that an electric field for attracting the toner to the electrode roller 372 is generated is applied.

In this embodiment, the toner is negatively charged by the charge control agent, and therefore for example, a voltage of −300 V is applied to the electrode roller 372, and a voltage of −1000 V is applied to the coating electrode member 371. As a result, during the passing of the liquid developer through the gap 377, the toner is carried on the electrode roller 372, so that the toner and the collect are separated from each other. The separated carrier liquid is discharged to the discharge portion 376*b* connected with the downstream end portion 377*b* of the gap 377.

The toner collecting device 380 is positioned downstream of the coating electrode member 371 with respect to the rotational direction of the electrode roller 372, and collects the toner carried on the electrode roller 372. The collecting device 380 including a collecting roller 381, the voltage applying device 375 as a collecting voltage applying means, and a blade member 382 as a scraping member. The voltage applying device 375 and the above-described voltage applying device 345 can be the same or different from each other.

The collecting roller 381 is provided in contact with the electrode roller 372. Further, the collecting roller 381 contacts the electrode roller 372 and is rotated by the electrode roller 342 in arrow directions of FIGS. 6 and 7. As shown in FIGS. 9 and 10, the electrode roller 372 and the collecting roller 371 are disposed substantially parallel to each other, and both end portions of these rollers 372 and 381 with respect to a rotational axis direction are rotatably supported by frames 376*e* constituting the liquid accommodating container 376. At both end portions of the collecting roller 381, urging mechanisms 383 such as springs are provided. The collecting roller 381 is urged toward the electrode roller 372 by the urging mechanisms 383, so that the electrode roller 372 is elastically deformed.

The voltage applying device 375 is connected with the electrode roller 372 and the collecting roller 381 as shown in FIG. 3, and applies a voltage between the collecting roller 381 and the electrode roller 372 so that an electric field for moving the toner toward the collecting roller 381 is generated. In this embodiment, for example, a voltage of −300 V is applied to the electrode roller 372, and a voltage of −200 V is applied to the collecting roller 381. Thus, the toner which is carried on the electrode roller 372 and which is fed toward the collecting roller 381 is moved from the electrode roller 372 to the collecting roller 381.

The blade member 382 solid components off the toner on the collecting roller 381 in contact with the collecting roller 381. The blade member 382 is disposed at a position downstream of a position of contact between the electrode roller 372 and the collecting roller 381 with respect to a rotational direction of the collecting roller 381 so that the blade member 382 contacts the collecting roller 381 with respect to a counter direction to the rotational direction of the collecting roller 381. As described above, the toner moved from the electrode roller 372 to the collecting roller 381 is scraped off by the blade member 382 and then is sent to the collecting portion 384. The toner collected in the collecting portion 384 is sent to the waste liquid collecting container 35 as described above.

Further, also a positional relation between upstream and downstream end portions of the gap 377 of the first separation and extraction device 37 is the same as that in the case of the above-described second separation and extraction device 34. That is, as shown in FIG. 7, in the case where a line α passing through a center O of the electrode roller 372 and a top of the electrode roller 342 with respect to the direction of gravitation is 0°, an upstream end portion 377*a* of the gap 377 is positioned in a range of 0° or more and less than 180° with respect to the rotational direction of the electrode roller 372. In a preferred example, the upstream end portion 377*a* of the gap 377 is positioned in a range of 60° or more and 120° or less with respect to the rotational direction of the electrode roller 372. In this embodiment, the upstream end portion 377*a* is positioned in a range from 90° to 120° with respect to the rotational direction of the electrode roller 372.

A downstream end portion 377*b* of the gap 377 is positioned below the upstream end portion 377*a* with respect to the direction of gravitation. In a preferred example, the downstream end portion 377*b* of the gap 377 is positioned in a range of 180° or less with respect to the rotational direction of the electrode roller 372. Further, a length of the gap 377, i.e., a length from the upstream end portion 377*a* to the downstream end portion 377*b* along the electrode roller 372 may preferably be not less than ⅕ of a peripheral length of an outer peripheral surface of the electrode roller 372.

Incidentally, the first separation and extraction device 37 may also have a constitution different from the constitution of the second separation and extraction device 34 if the separation and extraction process of the toner and the carrier liquid is performed.

(Control Flow of Separation and Extraction Operation of Liquid Developer)

Figure 11:
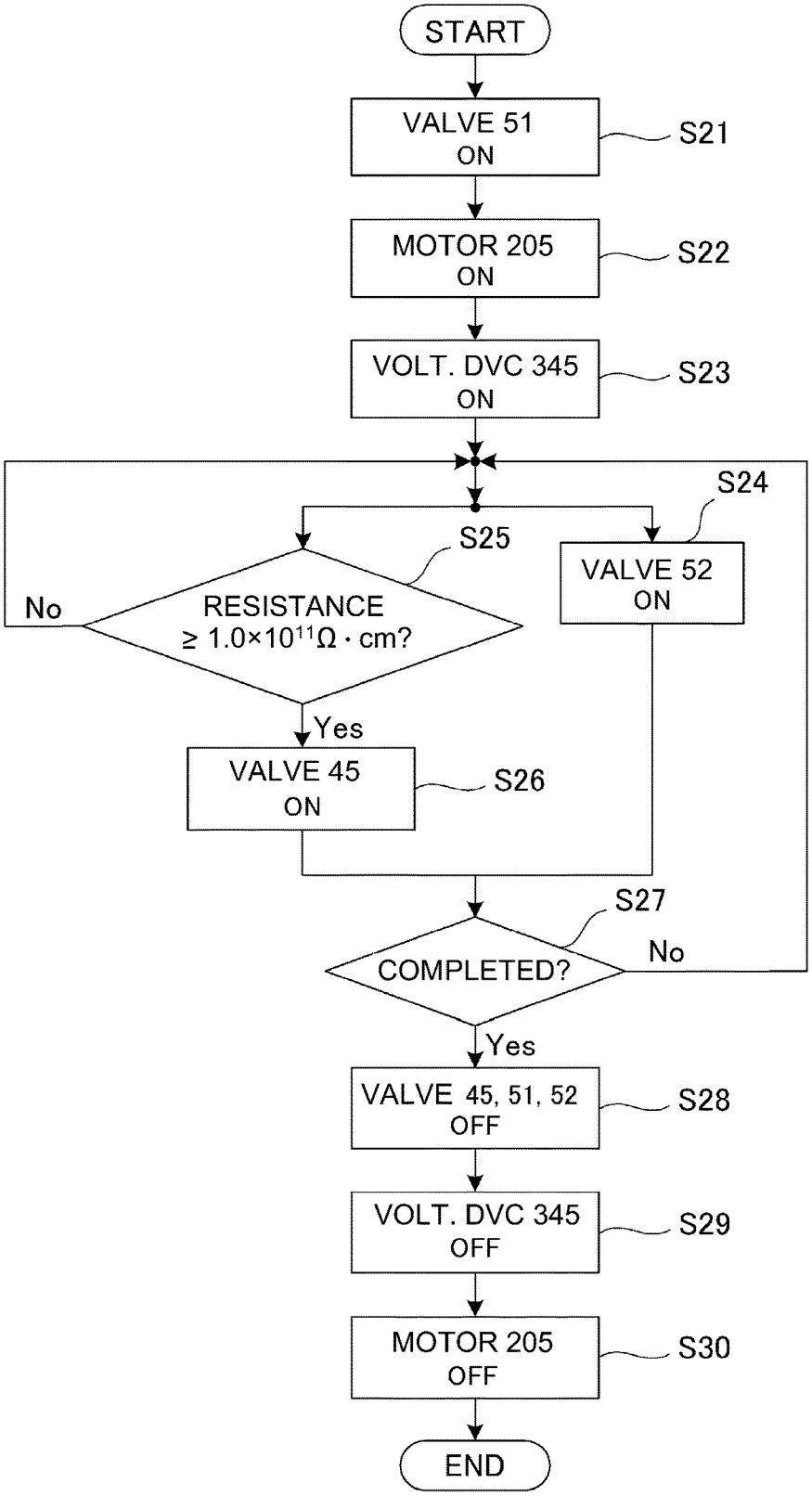
FIG. 11 is a flowchart showing control of a separation and extraction operation of the liquid developer in the First Embodiment.
Figure 12:
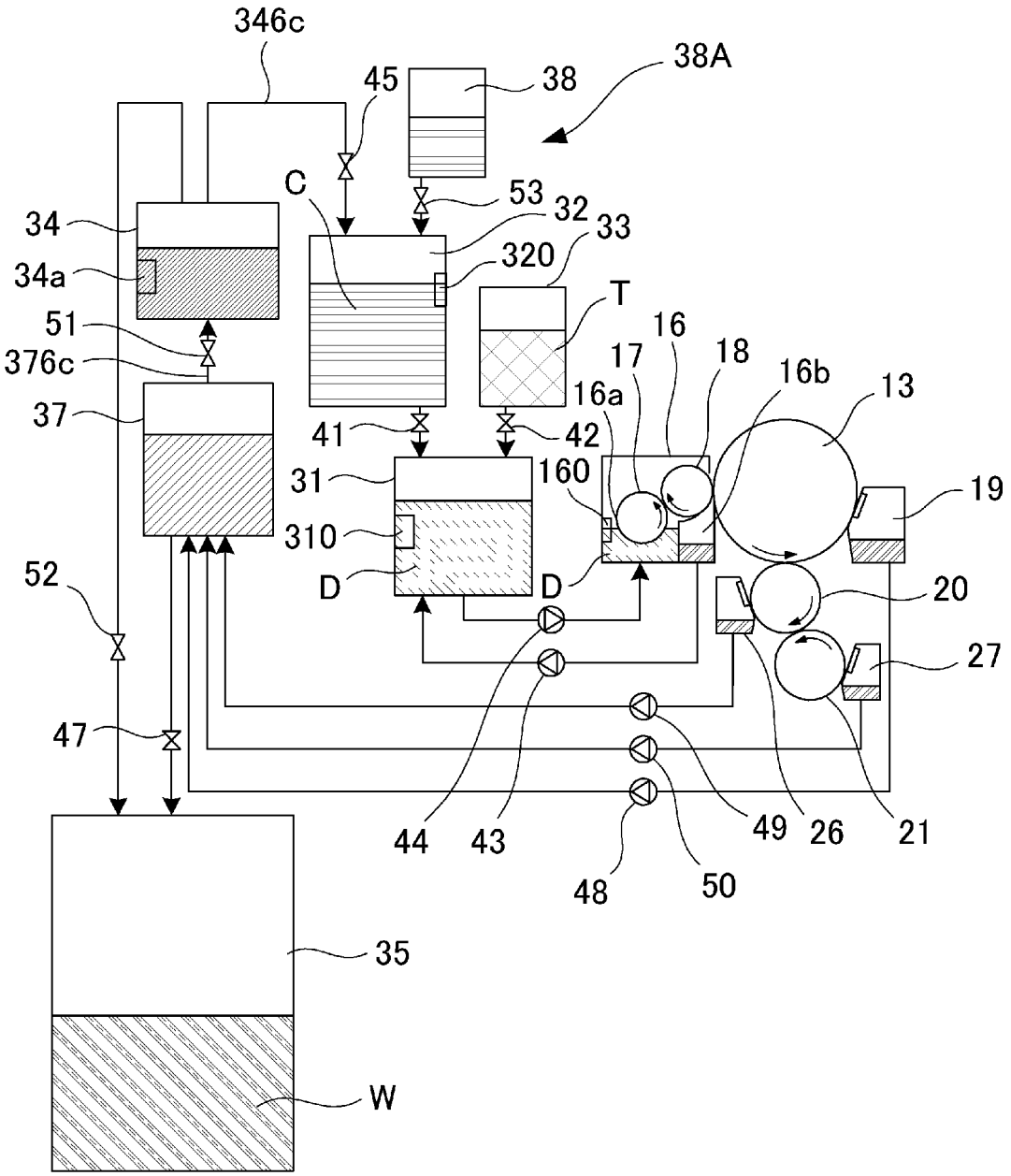
FIG. 12 is a schematic illustration showing a feeding path of a liquid developer in an image forming apparatus according to another example of the First Embodiment.
Figure 13:
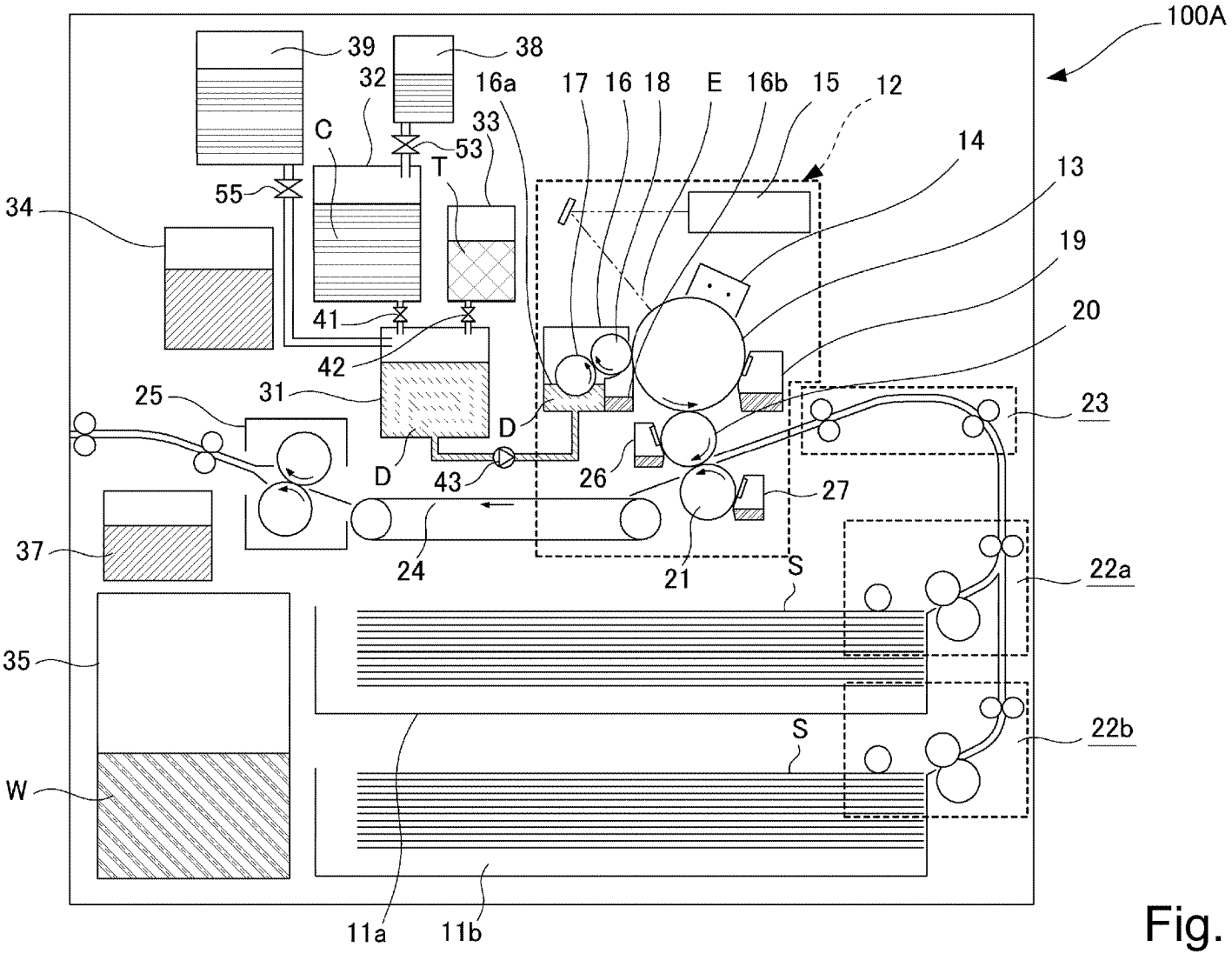
FIG. 13 is a schematic illustration of an image forming apparatus according to a Second Embodiment.

Next, a control flow of a separation and extraction operation of the liquid developer in the second separation and extraction device 34 constituted as described above in this embodiment will be described using FIGS. 11 and 12. First, the electromagnetic valve 51 provided to the transporting pipe 376*c* is opened, so that the carrier liquid, in a predetermined amount, separated by the first separation and extraction device 37 is sent to the second separation and extraction device 34, and then the electromagnetic valve 51 is closed (S21).

Then, the drive of the driving motor 205 is started, so that the electrode roller 342 is rotated (S22). As a result, the carrier liquid (liquid developer) is fed with rotation of the electrode roller 342. At this time, the collecting roller 351 is rotated by the electrode roller 342. Further, the voltage applying device 345 is turned on (S23). As a result, a voltage is applied between the coating electrode member 341 and the electrode roller 342 so that an electric field for moving the low-resistance carrier toward the electrode roller 342 is generated, and a voltage is applied between the collecting roller 351 and the electrode roller 342 so that an electric field for moving the low-resistance carrier toward the collecting roller 351 is generated. For this reason, the low-resistance carrier in the carrier liquid is first moved toward the electrode roller 342 and then is moved toward the collecting roller 351. The carrier liquid (high-resistance carrier) from which the low-resistance carrier is removed remains on the coating electrode member 341 side.

That is, the toner low-resistance carrier in the liquid developer passing through the gap 347 not only is electrically attracted to the electrode roller 342 but also receives an electrically repelling force from the coating electrode member 341. As a result, the low-resistance carrier is electrically urged toward the electrode roller 342. Further, the low-resistance carrier, in the carrier liquid, which passed through the gap 347 and which was then fed to the collecting roller 351 by the electrode roller 342 not only is electrically attracted to the collecting roller 351 but also receives an electrically repelling force from the electrode roller 342. As a result, the low-resistance carrier is electrically urged in a direction of being spaced from the electrode roller 342, i.e., toward the collecting roller 351.

The low-resistance carrier electrically deposited on the collecting roller 351 is scraped off by the blade member 352. Here, the electromagnetic valve 52 is opened (S24). As a result, the low-resistance carrier scraped by the blade member 352 falls by its own weight and then is collected into the waste liquid collecting container 35 through the collecting portion 354. Incidentally, the low-resistance carrier may be disposed of or reused.

Further, the high-resistance carrier (carrier liquid) discharged to the discharge portion 346*b* through the downstream end portion 347*b* of the gap 347 is subjected to detection of the volume resistivity by the carrier liquid resistance detecting device 34*a*. Then, whether or not the detected volume resistivity is a predetermined value (e.g., $1.0\times10^{11}$ Ω·cm) or more is discriminated (S25). When the volume resistivity is the predetermined value or more, the electromagnetic valve 45 is opened, so that the carrier liquid is sent to the carrier tank 32 (S26).

Then, when the separation and extraction of the carrier liquid from the second separation and extraction device 34 is completed (S27), the electromagnetic valves 45, 51 and 52 are closed (S28), and the voltage applying device 345 and the driving motor 205 are successively stopped (S29, S30).

Then, the carrier liquid, in a predetermined amount, separated by the first separation and extraction device 37 is fed again into the second separation and extraction device 34 by the electromagnetic valve 51, and a subsequent separation process is performed. Thereafter, such an operation is repeated.

In the first and second separation and extraction devices 37 and 34 in this embodiment, from 100.0 cc of the liquid developer (containing 90.0 cc of the carrier liquid and 10.0 cc of the toner), 88.0 cc of the carrier liquid can be extracted. A required time in one separation process is 30 seconds, for example, and in this case, it is possible to meet a process speed up to 800 mm/s.

As described above, in the case of this embodiment, the carrier liquid, of the high-resistance carrier, from which the low-resistance carrier such as the charge control agent is removed is extracted by the second separation and extraction device 34. For this reason, a lowering in volume resistivity of the carrier liquid to be reused can be suppressed, and also the generation of the image defect can be suppressed.

That is, in the case of this embodiment, from the liquid developer collected at the image forming portion 12, first, the toner is separated by the first separation and extraction device 37. Next, the liquid developer from which the toner is separated is sent to the second separation and extraction device 34. Then, by the second separation and extraction device 34, the low-resistance carrier such as the charge control agent which is the first substance having the opposite polarity to the toner charge polarity is separated from the liquid developer, and then the carrier liquid from which the low-resistance carrier is separated is sent to the carrier tank 32 and then is used again. For this reason, it is possible to increase the volume resistivity of the carrier liquid which is sent to the carrier tank 32 and which is then reused.

Incidentally, in the above description, from the liquid developer collected at the image forming portion 12, first, the toner is separated and then the low-resistance carrier is separated, but the order of separation of these substances may also be reversed. However, from the following reason, the above-described order is preferred. For example, in the case where the negative charge amount of the toner is larger than the positive charge amount (in absolute value), a negative charge component of the toner and a positive charge component are rarely electrostatically attracted to each other in some instances. In such a case, when the low-resistance carrier is removed first and then the toner is intended to be removed, in a step of separating the low-resistance carrier, the positive charge component, of the low-resistance carrier, attracted to the toner remains in the carrier liquid in some instances. Thus, also in a subsequent step of separating the toner, there is a possibility that the low-resistance carrier remains in the carrier liquid and thus the volume resistivity of the carrier liquid intended to be reused cannot be sufficiently lowered. For this reason, as described above, it is preferable that the toner is separated first and then the low-resistance carrier is separated. Particularly, in this embodiment, the charge amount of the toner is larger than the charge amount of the low-resistance carrier, and therefore this order is preferred.

Further, other than the use of the pump, in the case where the feeding of the liquid developer or the like can be made by, e.g., self-weight fall, such as a feeding type using the self-weight without providing the pump may also be used.

Another Example of First Embodiment

Another example of the First Embodiment will be described using FIG. 12. In this example, a supplying device 38A for supplying a carrier liquid for supply to the carrier tank 32 is provided. The supplying device 38A includes a supply carrier tank 38 and an electromagnetic valve 53 provided to a communication pipe for establishing communication between the supply carrier tank 38 and the carrier tank 32.

In the carrier tank 32, a float sensor 320 as a liquid amount detecting means detects a liquid amount of the carrier liquid in the carrier tank 32. The float sensor 320 detects the liquid amount in the carrier tank 32 by detecting a position (liquid level) of a float floated on a liquid surface. As the float sensor 320, for example, a float sensor in which a float provided with a magnet and a reed switch are provided and a position of the float is detected by the reed switch is used. The liquid amount detecting means may also have a constitution other than the float sensor described above.

The supplying device 38A supplies the carrier liquid for supply into the carrier tank (carrier container) 32 on the basis of the float sensor 320. Specifically, when detection that the liquid level of the carrier liquid in the carrier tank 32 is not more than a predetermined position (level) is made by the float sensor 320, the electromagnetic valve 53 is opened, so that the carrier liquid for supply is supplied from the supply carrier tank 38 to the carrier tank 32. Such control is effected by the CPU 200 (FIG. 3). That is, a detection result of the float sensor 320 is sent to the CPU 200, and then on the basis of this detection result, the CPU 200 controls the electromagnetic valve 53.

The carrier liquid for supply accommodated in the supply carrier tank 38 is a fresh carrier liquid or a carrier liquid having a high volume resistivity. Such a carrier liquid for supply may preferably be higher in volume resistivity than the carrier liquid which is separated and extracted by the second separation and extraction device 34 and which is then sent to the carrier tank 32. In the case where the carrier liquid for supply is the fresh carrier liquid, the volume resistivity thereof may preferably be, e.g., $1.0\times10^{14}$ Ω·cm or more. Further, the carrier liquid having the high volume resistivity may preferably have the volume resistivity of $1.0\times10^{12}$ Ω·cm or more.

According to this example, in the case where the carrier amount in the carrier tank 32 is not more than the predetermined amount, it is possible to automatically supply the carrier liquid for supply. During a period of existence of the carrier liquid in an amount not less than the predetermined amount in the carrier tank 32, the carrier liquid for supply is not supplied. During this period, a carrier liquid for recycling separated and extracted by the second separation and extraction device 34 can be used preferentially, so that a supplying cycle of the carrier liquid for supply can be prolonged.

Incidentally, a constitution in which the supply carrier tank 38 exclusively for supplying the carrier liquid for supply is not provided and the carrier liquid for supply is directly supplied to the carrier tank 32 may also be employed. Other constitutions and actions are similar to those in the First Embodiment.

Second Embodiment

The Second Embodiment of the present invention will be described using FIGS. 13 to 17. In the First Embodiment described above, the high-resistance carrier (carrier liquid) separated and extracted by the second separation and extraction device 34 was supplied to the carrier tank 32. On the other hand, in an image forming apparatus 100A in this embodiment, the low-resistance carrier separated and extracted by a second separation and extraction device 34 is supplied to a carrier tank 32. Further, the high-resistance carrier separated and extracted by the second separation and extraction device 34 is supplied to a mixer 31 via a second carrier tank 39 as a second carrier container. Other basis constitutions and actions are similar to those in the above-described First Embodiment, and therefore in the following, the similar constitutions will be omitted from description and illustration or briefly described, and a portion different from the First Embodiment will be principally described.

Figure 14:
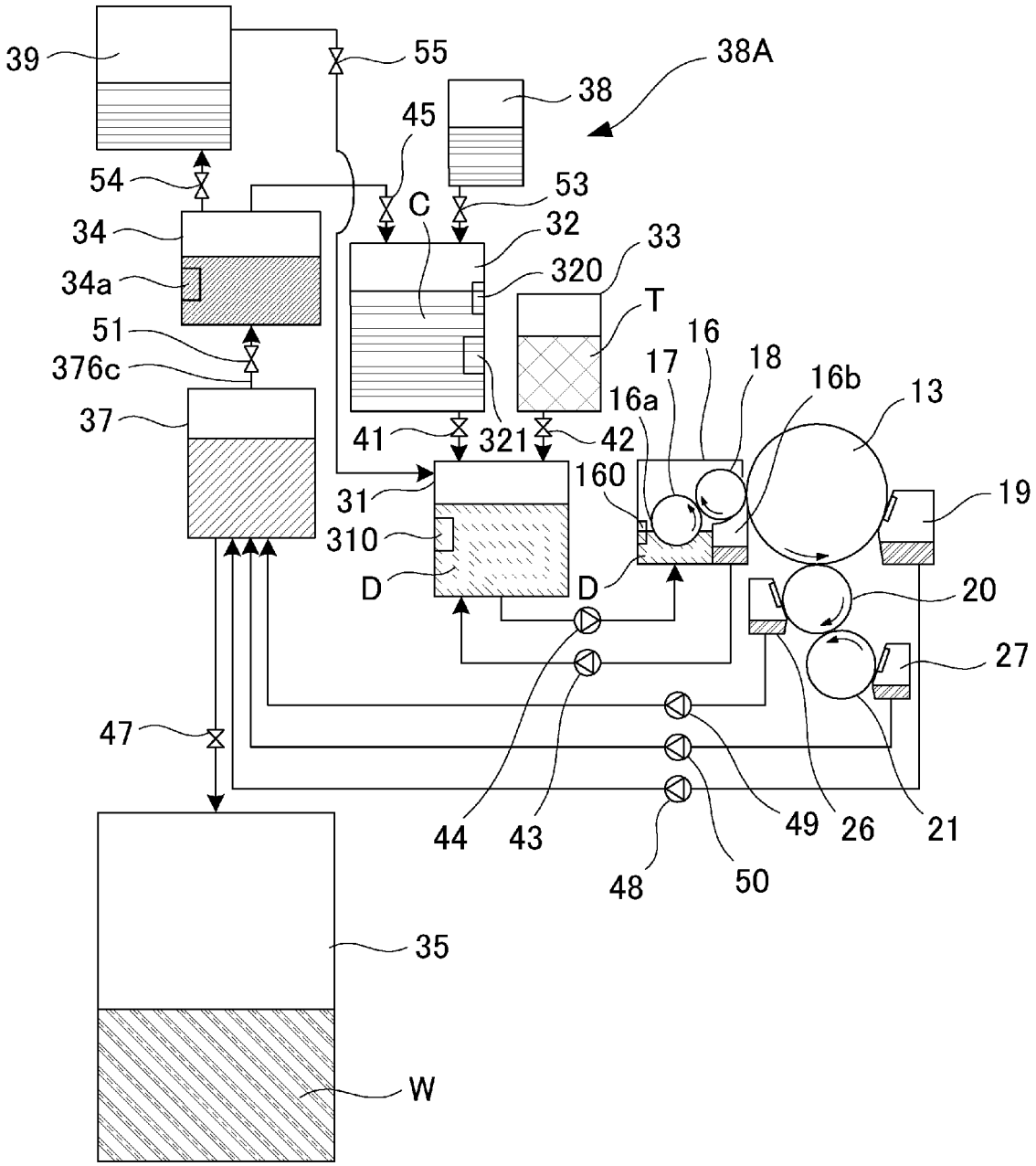
FIG. 14 is a schematic illustration showing a feeding path of a liquid developer in the image forming apparatus in the Second Embodiment.

As shown in FIG. 14, transporting pipes from the carrier tank 32, the second carrier tank 39 and a toner tank 33 to the mixer 31 are provided with electromagnetic valves 41, 55 and 42, respectively, so that a supply amount of the carrier liquid C or the toner T to the mixer 31 is adjusted. From the mixer 31, using a pump 44, a developer D necessary for development is supplied to the developing device 16.

The liquid developer collected at the image forming portion 12 is fed to the first separation and extraction device 37 by the pumps 48, 49 and 50, and then is separated into the toner and the carrier liquid. Then, the carrier liquid (liquid developer) separated and extracted by the first separation and extraction device 37 is fed to the second separation and extraction device 34 by the electromagnetic valve 51. On the other hand, the waste liquid W containing the toner and the impurity is appropriately fed by the self-weight fall to the waste liquid collecting container 35 by the electromagnetic valve 47 provided to the transporting pipe.

In the second separation and extraction device 34, the first substance (low-resistance carrier) having the opposite polarity to the toner charge polarity and the second substance (high-resistance carrier) having the intermediary charge amount between the charge amounts of the toner and the first substance are separated from the carrier liquid separated and extracted by the first separation and extraction device 37. Then, a liquid containing the first substance (principally the charge control agent), separated from the second substance, and the impurity is supplied to the carrier tank 32 by the electromagnetic valve 45, as a first gap means. On the other hand, the high-resistance carrier (carrier liquid) from which the first substance is separated by the second separation and extraction device 34 is fed to the second carrier tank 39 by the electromagnetic valve 54.

Figure 15:
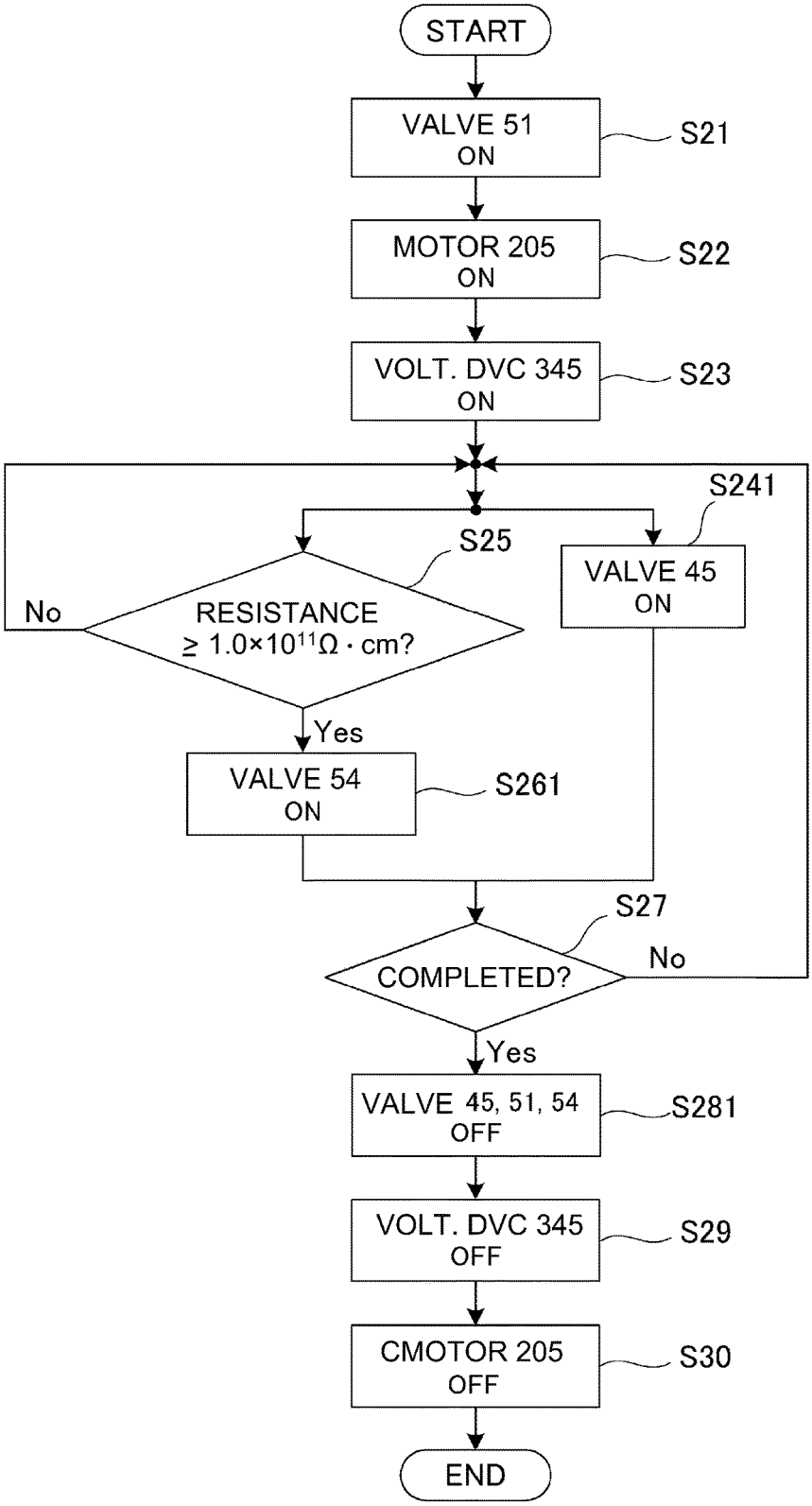
FIG. 15 is a flowchart showing control of a feeding and extracting operation of the liquid developer in the Second Embodiment.
Figure 16:
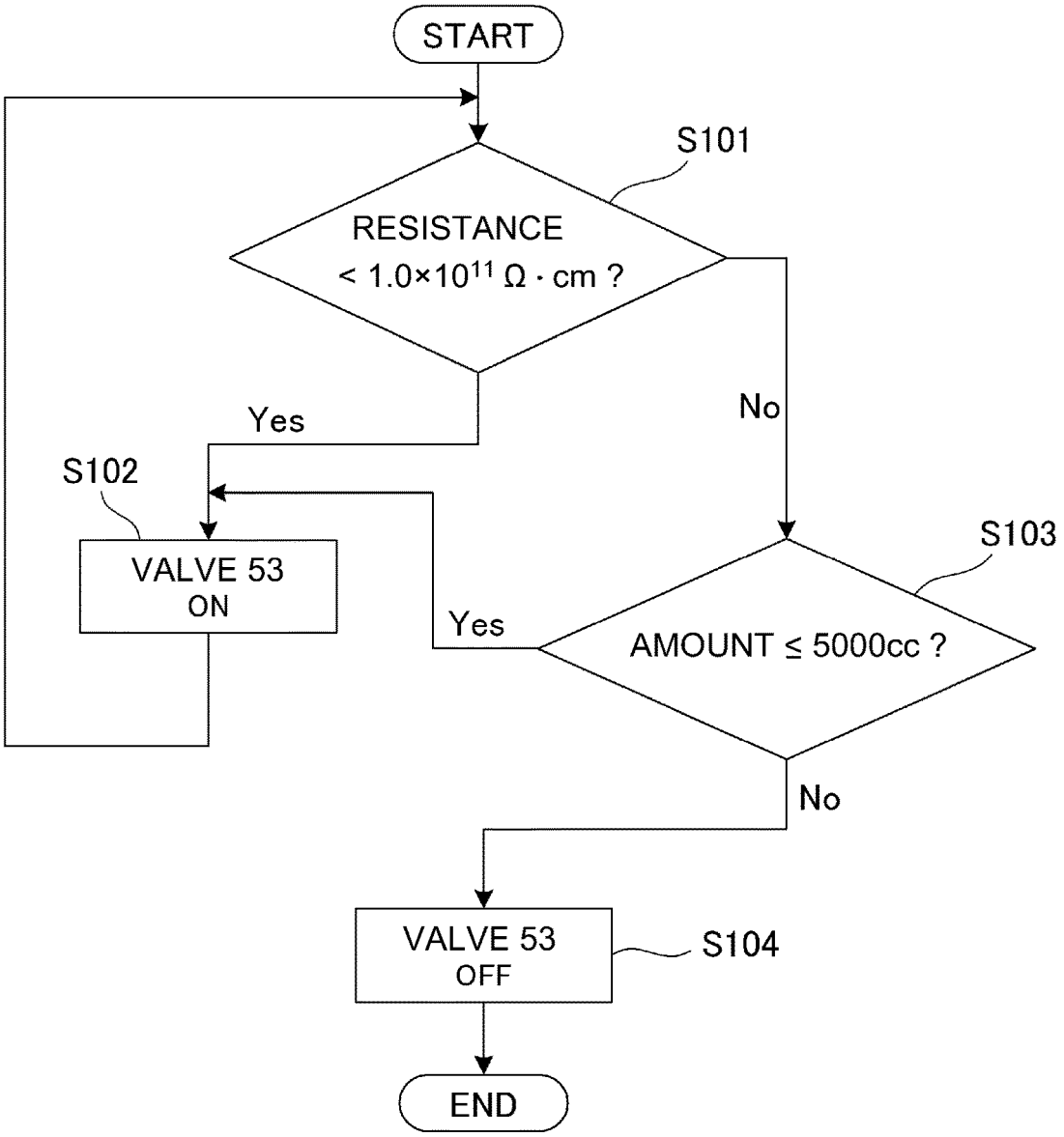
FIG. 16 is a flowchart showing control of a supplying operation of the liquid developer to a carrier tank in the Second Embodiment.

A control flow of a separation and extraction operation of the liquid developer in the second separation and extraction device 34 in this embodiment is as shown in FIG. 15. Also in the case of this embodiment, the discharge portion 346*b* of the second separation and extraction device 34 is provided with the carrier liquid resistance detecting device 34*a*, so that the volume resistivity of the high-resistance carrier (carrier liquid) separated and extracted by the second separation and extraction device 34 is detected. FIG. 15 is substantially similar to FIG. 11 described in the First Embodiment except for the following points. The points different from FIG. 11 is that the second separation and extraction device 34 is operated and the electromagnetic valve 45 is opened (S241), that when the volume resistivity is not less than a predetermined value in S25, the electromagnetic valve 54 is opened and thus the carrier liquid is sent to the second carrier tank 39 (S261), and that when the separation and extraction is completed in S27, the electromagnetic valves 45, 51 and 54 are closed (S281).

The high-resistance carrier fed to the second carrier tank 39 is appropriately fed to the mixer 31 by the electromagnetic valve 55 as the second supplying means. That is, the high-resistance carrier obtained by separating the low-resistance carrier from the liquid developer by the second separation and extraction device 34 is supplied to the mixer 31 via the second carrier tank 39 by the electromagnetic valve 55.

In the case of this embodiment, similarly as in another example of the First Embodiment described with reference to FIG. 12, the supplying device 38A for supplying the carrier liquid for supply to the carrier tank 32 is provided. The supplying device 38A includes the supply carrier tank 38 and the electromagnetic valve 53 provided to the communication pipe for establishing communication between the supply carrier tank 38 and the carrier tank 32. In the supply carrier tank 38, as the carrier liquid for supply, similarly as in another example of the First Embodiment, the fresh carrier liquid or the carrier liquid having the high volume resistivity (e.g., $1.0\times10^{12}$ Ω·cm or more is accommodated.

In this embodiment, similarly as in another example of First Embodiment, in the carrier tank 32, the float sensor 320 as the liquid amount detecting means for detecting the liquid amount of the carrier liquid in the carrier tank 32 is provided. Further, in this embodiment, in the carrier tank 32, a carrier liquid resistance detecting device 321 as a resistance detecting mean for detecting the volume resistivity of the carrier liquid in the carrier tank 32 is provided. A constitution of the carrier liquid resistance detecting device 321 is the same as the constitution of the above-described carrier liquid resistance detecting device 34*a*.

The supplying device 38A supplies the carrier liquid for supply into the carrier tank (carrier container) 32 on the basis of detection results of the float sensor 320 and the carrier liquid resistance detecting device 321. This operation will be described using FIG. 16. First, the volume resistivity of the carrier liquid in the carrier tank 32 is detected by the carrier liquid resistance detecting device 321 (S101). In the case where a detection result is less than a predetermined value (e.g., $1.0\times10^{11}$ Ω·cm), the electromagnetic valve 53 is opened and then the carrier liquid for supply is supplied from the supply carrier tank 38 to the carrier tank 32 (S102).

Then, when by the float sensor 320, detection that the liquid level (position) of the carrier liquid in the carrier tank 32 is not more than a predetermined position (e.g., not more than 5000 cc) is made (S103), the electromagnetic valve 53 is opened. Then, the carrier liquid for supplying is supplied from the supply carrier tank 38 to the carrier tank 32 (S102). In the case where the volume resistivity of the carrier liquid in the carrier tank 32 is not less than the predetermined value and the liquid level is higher than the predetermined position, the electromagnetic valve 53 is closed (S104), so that the control is ended. Such control is effected by the CPU 200 (FIG. 3). That is, the detection results of the float sensor 320 and the carrier liquid resistance detecting device 321 are sent to the CPU 200, and then the CPU 200 controls the electromagnetic valve 53 on the basis of the detection results.

As a result, in the case where the carrier liquid amount in the carrier tank 32 is not more than the predetermined amount or the volume resistivity of the carrier liquid is not more than the predetermined value, it is possible to automatically supply the fresh carrier liquid or the carrier liquid having the high volume resistivity.

Figure 17:
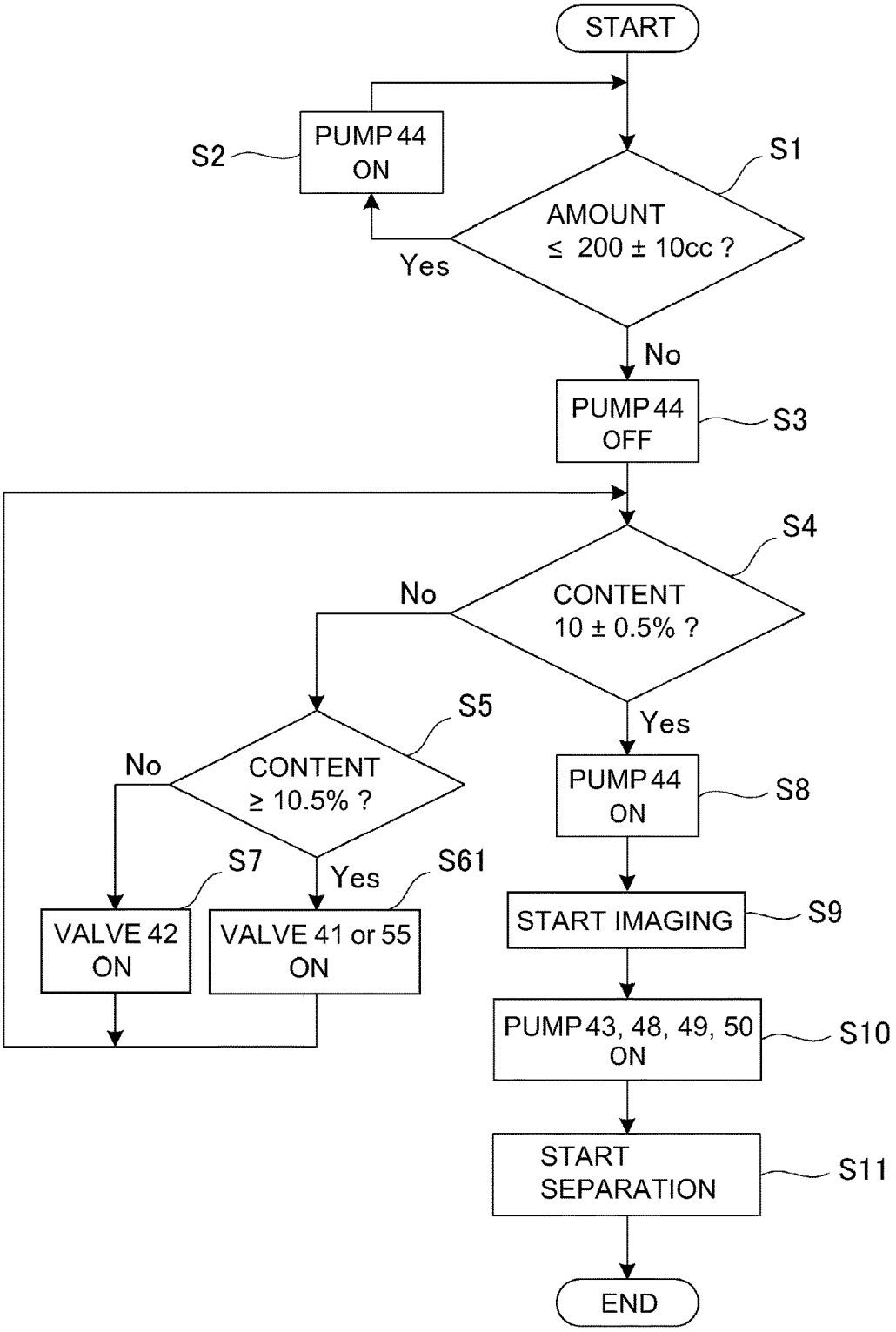
FIG. 17 is a flowchart showing control of a feeding operation of the liquid developer in the image forming apparatus in the Second Embodiment.

Such a feeding operation of the liquid developer in this embodiment is as shown in FIG. 17. Also in the case of this embodiment, the developing device 16 is provided with a developer amount detecting device 160 and the developer amount detecting device 160 detects an amount of the liquid developer in the developing device 16. Further, the mixer 31 is provided with a solid component content detecting device 310 and the solid component content detecting device 310 detects the content of the solid component such as the toner in the mixer 31. FIG. 17 is substantially similar to FIG. 4 described in the First Embodiment except for the following point. The point different from FIG. 4 is that in S5, in the case where the solid component content is 10.5% or more, the electromagnetic valve 41 or 55 opened and thus the carrier liquid is supplied from the carrier tank 32 or the second carrier tank 39 into the mixer 31 (S61).

Incidentally, either one of the electromagnetic valves 41 and 55 may be opened preferentially, and the electromagnetic valves 41 and 55 may also be alternately opened or simultaneously opened. However, it is preferable that the carrier liquid to be reused is used preferentially, and in this case, the electromagnetic valve 55 is opened preferentially and thus the carrier liquid is supplied from the second carrier tank 39 to the mixer 31. Then, in the case where the liquid amount in the second carrier tank 39 is not more than the predetermined amount, the electromagnetic valve 41 is opened and thus the carrier liquid is supplied from the carrier tank 32 to the mixer 31.

In the case of this embodiment described above, it is possible to suppress a lowering in volume resistivity of the carrier liquid to be reused while effectively using the low-resistance carrier separated and extracted by the second separation and extraction device 34. That is, in this embodiment, the carrier liquid separated and extracted by the second separation and extraction device 34 is supplied to the carrier tank 32. Into the carrier tank 32, from the supply carrier tank 38, the fresh carrier liquid or the carrier liquid having the high volume resistivity is supplied, and therefore even when the low-resistance carrier is supplied, the volume resistivity of the carrier liquid in the carrier tank 32 can be increased. Further, each of the low-resistance carrier from the second separation and extraction device 34 and the carrier liquid for supply from the supply carrier tank 38 is made supplyable into the carrier tank 32, and therefore it is easy to adjust the volume resistivity of the carrier liquid in the carrier tank 32.

Accordingly, as the carrier liquid to be reused, the liquid carrier properly adjusted in volume resistivity can be supplied from the carrier tank 32 to the mixer 31. Thus, in this embodiment, it is possible to suppress the lowering in volume resistivity of the carrier liquid to be reused while effectively using the low-resistance carrier separated and extracted by the second separation and extraction device 34. Incidentally, the high-resistance carrier separated and extracted by the separation and extraction device 34 can be reused by being directly supplied to the mixer 31. Other constitutions and actions are similar to those in the First Embodiment.

Another First Example of the Second Embodiment

Figure 18:
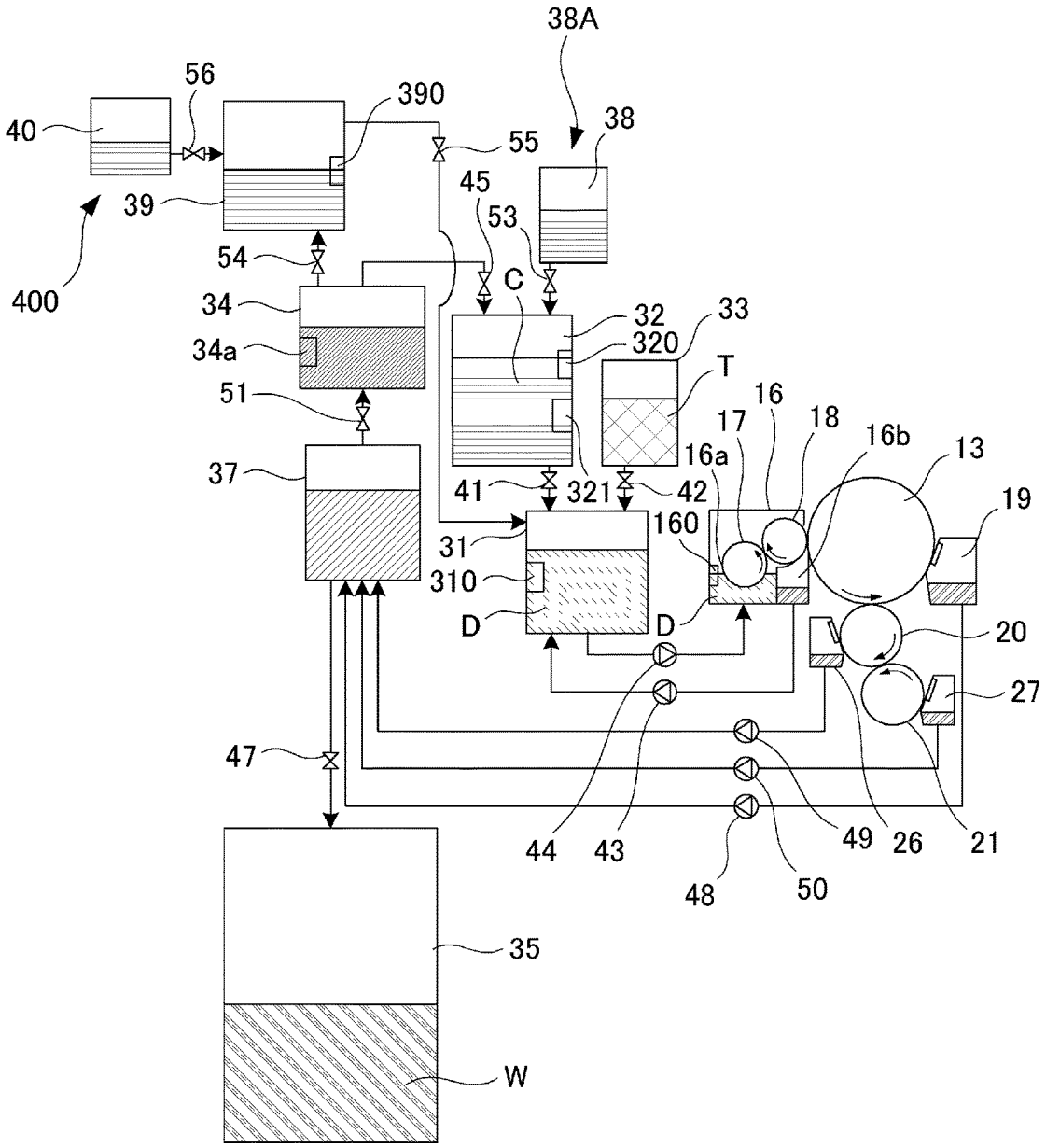
FIG. 18 is a schematic illustration showing a feeding path of a liquid developer in an image forming apparatus according to another example of the First Embodiment.

Another first example of the Second Embodiment will be described using FIG. 18. In this example, a second supplying device 400 for supplying a carrier liquid for supply (fresh carrier liquid or carrier liquid having high volume resistivity) to the second carrier tank 39 is provided. As the fresh carrier liquid, for example, the volume resistivity thereof may preferably be $1.0\times10^{14}$ Ω·cm or more, and as the carrier liquid having the high volume resistivity, for example, the volume resistivity thereof may preferably be $1.0\times10^{12}$ Ω·cm or more.

The second supplying device 400 includes a second supply carrier tank 40 and an electromagnetic valve 56 provided to a communication pipe for establishing communication between the second supply carrier tank 40 and the second carrier tank 39. In the second carrier tank 39, a float sensor 390 as a liquid amount detecting means detects a liquid amount of the carrier liquid in the second carrier tank 39. A constitution of the float sensor 390 is similar to the constitution of the above-described float sensor 320.

The second supplying device 400 supplies the carrier liquid for supply into the second carrier tank 39 on the basis of the float sensor 390. Specifically, when detection that the liquid level of the carrier liquid in the second carrier tank 39 is not more than a predetermined position (level) is made by the float sensor 390, the electromagnetic valve 56 is opened, so that the carrier liquid for supply is supplied from the second supply carrier tank 40 to the second carrier tank 39. Such control is effected by the CPU 200 (FIG. 3). That is, a detection result of the float sensor 390 is sent to the CPU 200, and then on the basis of this detection result, the CPU 200 controls the electromagnetic valve 56.

According to this example, in the case where the carrier amount in the second carrier tank 39 is not more than the predetermined amount, it is possible to automatically supply the carrier liquid for supply. During a period of existence of the carrier liquid in a member not less than the predetermined amount in the second carrier tank 39, the carrier liquid for supply is not supplied. During this period, a carrier liquid for recycling separated and extracted by the second separation and extraction device 34 can be used preferentially, so that a supplying cycle of the carrier liquid for supply can be prolonged.

Incidentally, a constitution in which the second supply carrier tank 40 exclusively for supplying the carrier liquid for supply is not provided and the carrier liquid for supply is directly supplied to the second carrier tank 39 may also be employed. Other constitutions and actions are similar to those in the Second Embodiment.

Another Second Example of the Second Embodiment

Figure 19:
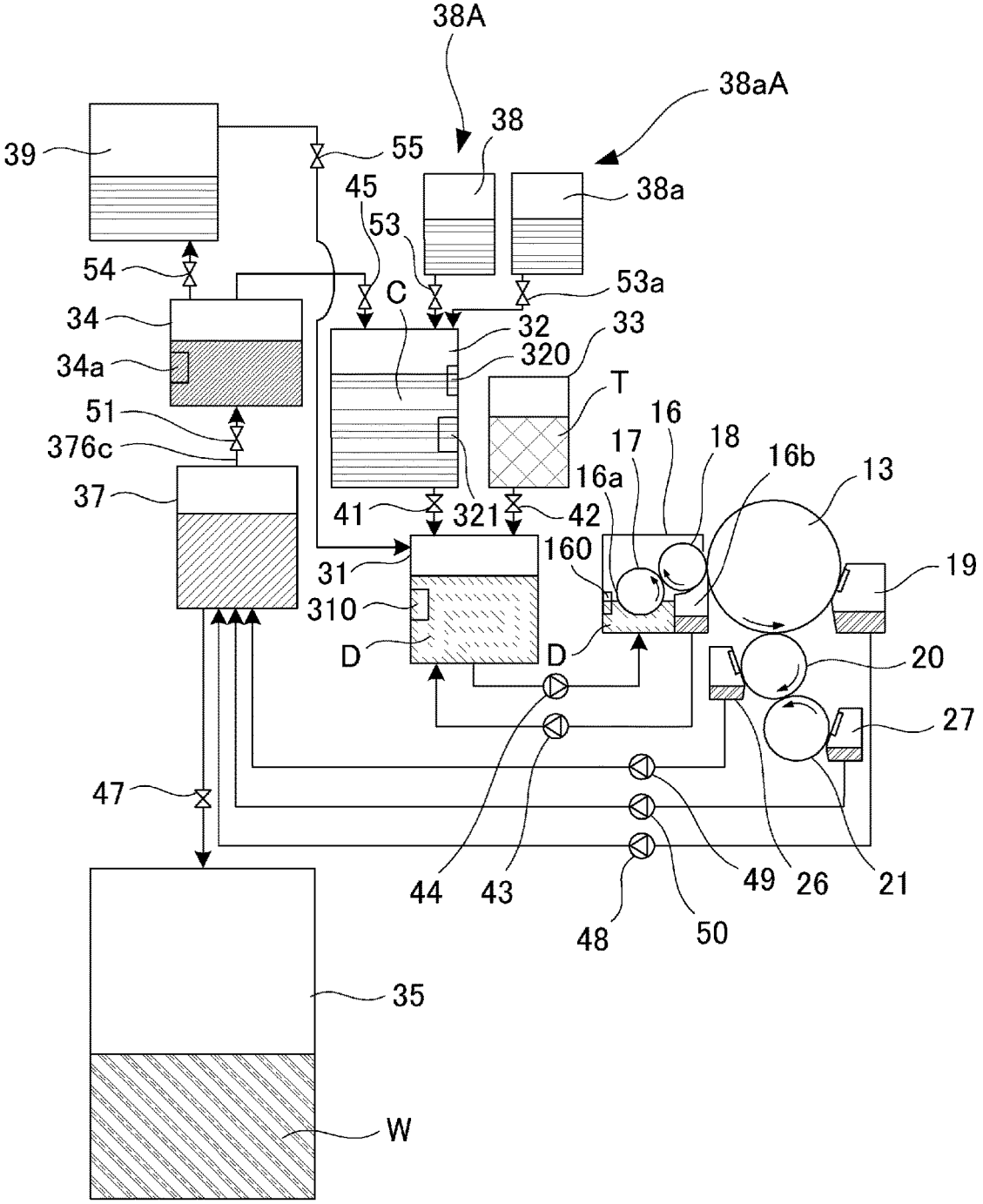
FIG. 19 is a schematic illustration showing a feeding path of a liquid developer in the image forming apparatus in another second example of the Second Embodiment.
Figure 20:
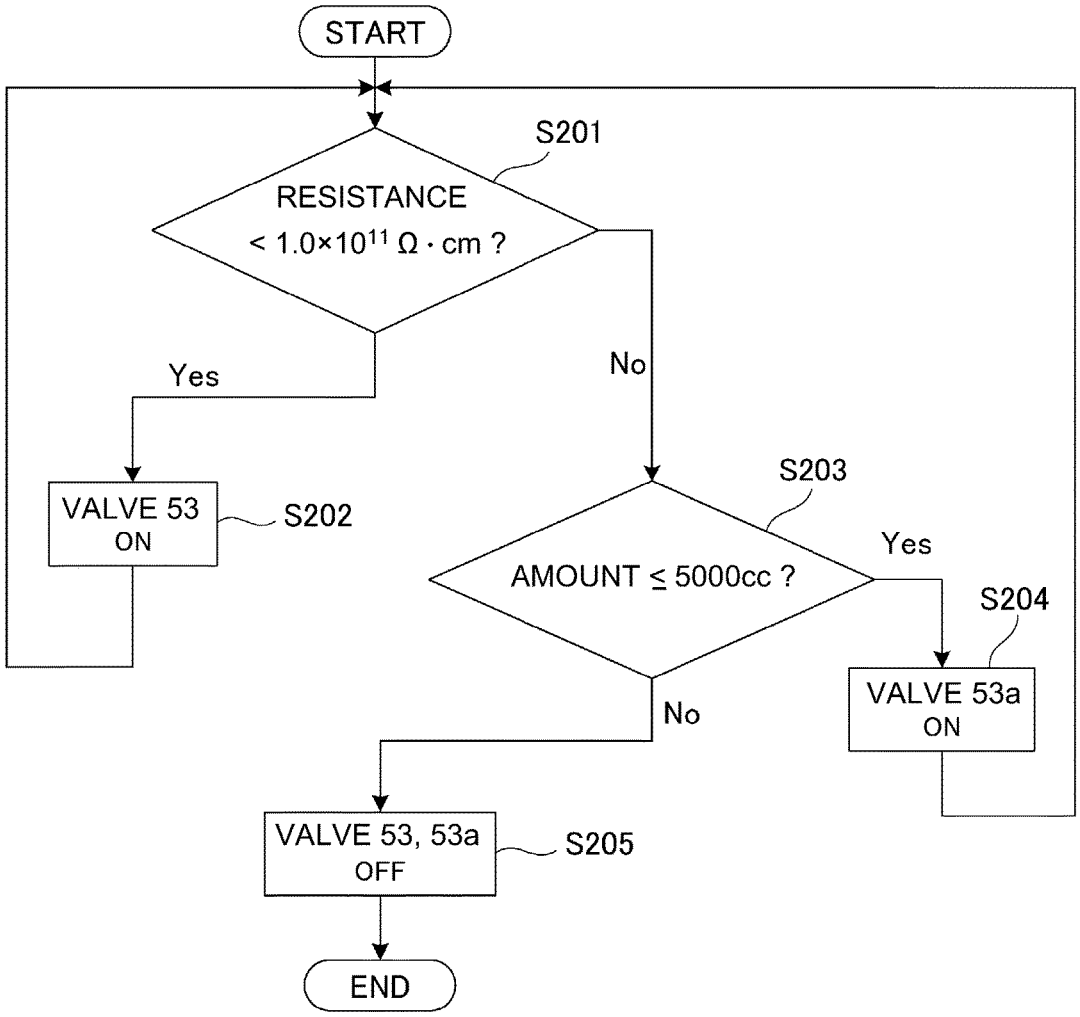
FIG. 20 is a flowchart showing control of a supplying operation of the liquid developer to a carrier tank in another second example of the Second Embodiment.

Another second example of the Second Embodiment will be described using FIGS. 19 and 20. In this example, with respect to the constitution of the Second Embodiment, as the supplying device for supplying the carrier liquid for supply (fresh carrier liquid or carrier liquid having high volume resistivity) to the carrier tank 32, in addition to the supplying device 38, another supplying device 38*a*A is provided.

Another supplying device 38*a*A includes another supply carrier tank 38*a* and an electromagnetic valve 53*a* provided to a communication pipe for establishing communication between another supply carrier tank 38*a* and the carrier tank 32. Here, the carrier liquid for supply in another supplying device 38*a*A is different in volume resistivity from the carrier liquid for supply in the supplying device 38A. For example, the volume resistivity of the carrier liquid in the supply carrier tank 38 of the supplying device 38A is made higher than the volume resistivity of the carrier liquid in another supply carrier tank 38*a* of another supplying device 38*a*A. Specifically, in the supply carrier tank 38, a fresh carrier liquid (e.g., having the volume resistivity of $1.0\times10^{14}$ Ω·cm or more) containing no charge control agent is accommodated. On the other hand, in another supply carrier tank 38*a*, a carrier liquid which contains a small amount of the charge control agent but which has a high volume resistivity (e.g., $1.0\times10^{12}$ Ω·cm or more) is accommodated.

The supplying device 38A and another supplying device 38*a*A supply the carrier liquid for supply into the carrier tank (carrier container) 32 on the basis of detection results of the float sensor 320 and the carrier liquid resistance detecting device 321. For example, on the basis of a detection result of the carrier liquid resistance detecting device 321, the electromagnetic valve 53 of the supplying device 38A is controlled, and on the basis of the detection result of the float sensor 320, the electromagnetic valve 53*a* of another supplying device 38*a*A is controlled.

This operation will be described using FIG. 20. First, the volume resistivity of the carrier liquid in the carrier tank 32 is detected by the carrier liquid resistance detecting device 321 (S201). In the case where a detection result is less than a predetermined value (e.g., $1.0\times10^{11}$ Ω·cm), the electromagnetic valve 53 is opened and then the carrier liquid for supply is supplied from the supply carrier tank 38 to the carrier tank 32 (S202).

Then, by the float sensor 320, detection that the liquid level (position) of the carrier liquid in the carrier tank 32 is not more than a predetermined position (e.g., not more than 5000 cc) is made (S203), the electromagnetic valve 53*a* is opened. Then, the carrier liquid for supplying is supplied from another supply carrier tank 38*a* to the carrier tank 32 (S204). In the case where the volume resistivity of the carrier liquid in the carrier tank 32 is not less than the predetermined value and the liquid level is higher than the predetermined position, the electromagnetic valves 53 and 53*a* are closed (S205), so that the control is ended. Such control is effected by the CPU 200 (FIG. 3). That is, the detection results of the float sensor 320 and the carrier liquid resistance detecting device 321 are sent to the CPU 200, and then the CPU 200 controls the electromagnetic valves 53 and 53*a* on the basis of the detection results.

As a result, in the case where the carrier liquid amount in the carrier tank 32 is not more than the predetermined amount or the volume resistivity of the carrier liquid is not more than the predetermined value, it is possible to automatically supply the fresh carrier liquid or the carrier liquid having the high volume resistivity.

Incidentally, the supplying operations of the carrier liquids from the supplying device 38A and another supplying device 38*a*A may also be those other than the above-described supplying operations. For example, on the basis of the detection result of the carrier liquid resistance detecting device 321, the carrier liquid for supply is supplied from another supplying device 38*a*A to the carrier tank 32. Further, on the basis of the detection result of the float sensor 320, the carrier liquid for supply may also be supplied from the supplying device 38A to the carrier tank 32. Or, the supplying operations of the carrier liquids from the supplying device 38A and another supplying device 38*a*A may also be performed simultaneously. That is, on the basis of the detection results of the float sensor 320 and the carrier liquid resistance detecting device 321, both of the electromagnetic valves 53 and 53*a* may also be controlled. Other constitutions and actions are similar to the Second Embodiment.

Another Third Example of the Second Embodiment

Figure 21:
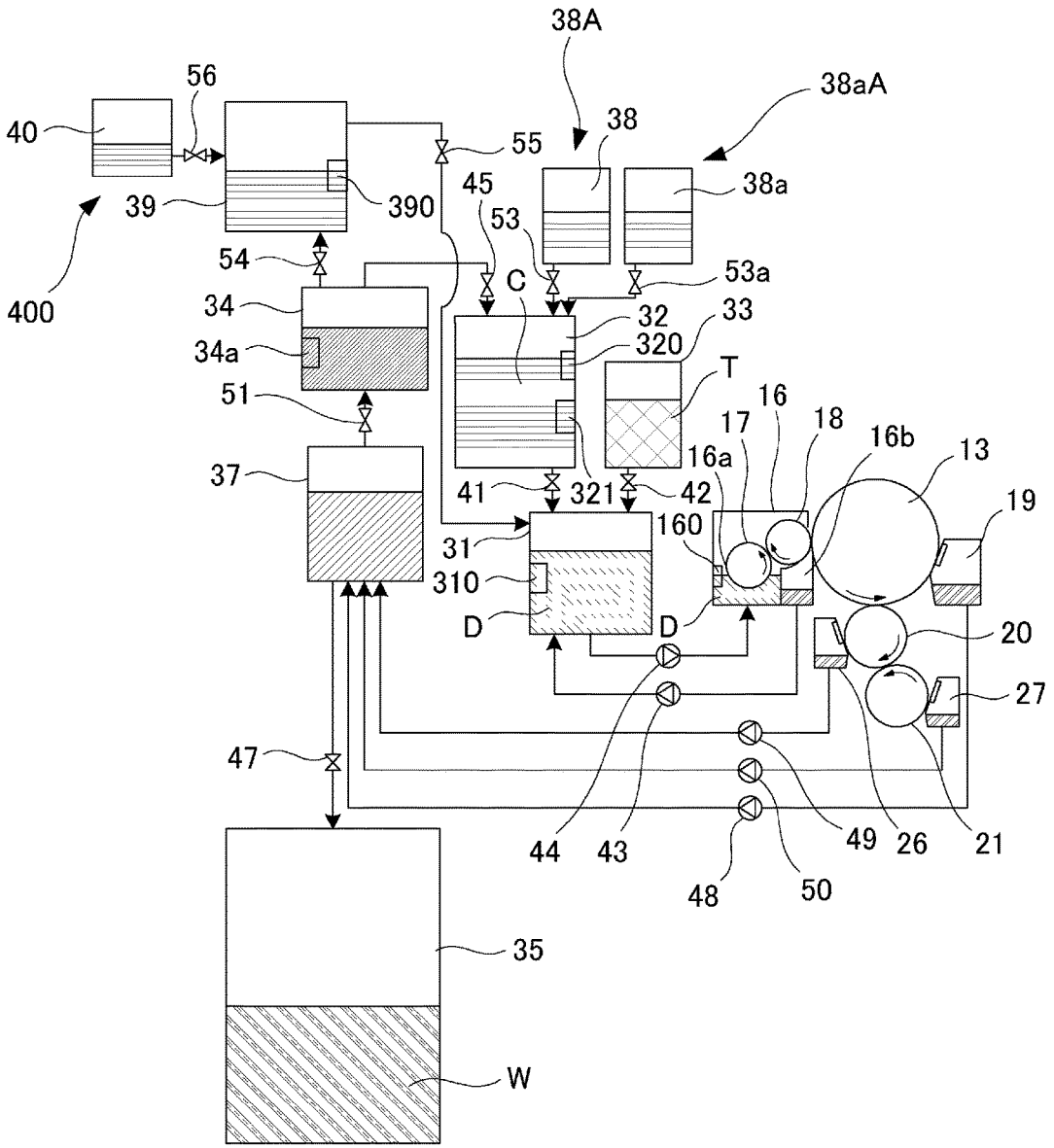
FIG. 21 is a flowchart showing a feeding path of the liquid developer in an image forming apparatus in another third example of the Second Embodiment.

Another third example of the Second Embodiment will be described using FIG. 21. In this example, another first example of the Second Embodiment and another second example of the Second Embodiment which are described above are combined with each other. That is, with respect to the constitution of the Second Embodiment, the second supplying device 400 and another supplying device 38*a*A are added. Constitutions and actions are similar to those of another first example of the Second Embodiment and another second example of the Second Embodiment.

In the above-described the Second Embodiment and each of another first, second and third examples, the carrier liquid resistance detecting device is provided in the carrier tank 32 but may also be provided in the mixer 31. In this case, the supply of the carrier liquid to the carrier tank is made on the basis of the detection result of the float sensor. On the other hand, the supply of the carrier liquid from the carrier tank 32 and the second carrier tank 39 to the mixer 31 is made on the basis of the detection result of the carrier liquid resistance detecting device.

Third Embodiment

The Third Embodiment of the present invention will be described using FIG. 22. In the above-described Embodiments, the constitution including the image forming portion 12 for a single color was described. On the other hand, in this embodiment, a plurality of unshown image forming portions are provided. In this embodiment, four image forming portions capable of forming toner images of colors of yellow (Y), magenta (M), cyan (C) and black (K) are provided, so that a full-color image is formable on a recording material.

Figure 22:
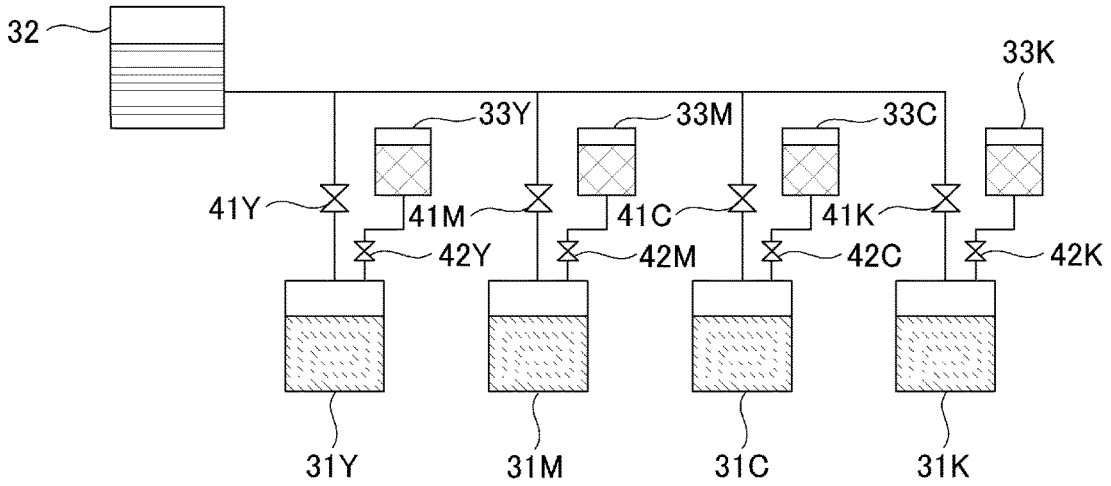
FIG. 22 is a schematic illustration showing a relation of carrier tanks with mixers in a Third Embodiment.

The four image forming portions have the same constitution as the constitution of the image forming portion 12 as shown in FIG. 1, and includes images 31Y, 31M, 31C and 31K, respectively, as shown in FIG. 22. The respective mixers 31Y, 31M, 31C and 31K supply liquid developers of the respective colors to associated ones of developing devices of the respective image forming portions. To the mixers 31Y, 31M, 31C and 31K, toners of the respective colors can be supplied from toner tanks 33Y, 33M, 33C and 33K, respectively. In the respective mixers 31Y, 31M, 31C and 31K, associated solid component content detecting devices are provided, and on the basis of detection results thereof, electromagnetic valves 42Y, 42M, 42C and 42K are controlled, respectively. Thus, the toners are appropriately supplied from the toner tanks 33Y, 33M, 33C and 33K.

On the other hand, a single carrier tank 32 for supplying the carrier liquid to the respective mixers 31Y, 31M, 31C and 31K is provided. That is, the carrier liquid is supplied from the single carrier tank 32 to the respective mixers 31Y, 31M, 31C and 31K. Communication pipes for establishing communication of the single carrier tank 32 with the mixers 31Y, 31M, 31C and 31K are provided with electromagnetic valves 41Y, 41M, 41C and 41K.

The electromagnetic valves 41Y, 41M, 41C and 41K are controlled on the basis of detection results of the carrier liquid resistance detecting devices of the mixers 31Y, 31M, 31C and 31K. Thus, the carrier liquid is appropriately supplied from the single carrier tank 32 to the mixers 31Y, 31M, 31C and 31K.

In this embodiment, the single carrier tank (carrier container) 32, the four mixers (mixing devices) 31Y, 31M, 31C and 31K and the four electromagnetic valves (carrier supplying devices for mixing) 41Y, 41M, 41C and 41K are provided. In other words, commonalty of carrier tanks for the respective image forming portions is achieved. This is because the carrier tanks can used in common to the respective image forming portions.

Also as regards the first and second separation and extraction devices for separating the liquid developers collected at the image forming portions for the respective colors, a single separation and extraction device is employed and is used in common to the image forming portions. Further, also the supply carrier tank 38 and the like described in the above-described embodiments are used in common. Incidentally, as in the Second Embodiment, in the case of a constitution including the second carrier tank 39, a single second carrier tank 39 is employed and the carrier liquid is supplied from the single second carrier tank 39 to the mixers 31Y, 31M, 31C, 31K for the respective colors.

In the case of this embodiment, the carrier tank 32 is used in common for the respective colors, and therefore downsizing and cost reduction of the image forming apparatus can be realized. Further, commonality of the first and second separation and extraction devices and the like is also achieved, so that the downsizing and the cost reduction can be further effectively realized. Other constitutions and actions are similar to those of either one of the above-described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

According to the present invention, a lowering in volume resistivity of the collect to be reused can be suppressed.

The invention claimed is:

1. An image forming apparatus comprising:

an image forming portion, including an image bearing member, configured to form a toner image on a recording material with a liquid developer containing a toner and a carrier liquid, wherein the carrier liquid contains a first substance, charged to an opposite polarity to a charge polarity of the toner, for imparting an electrical polarity to the toner and a second substance, higher in volume resistivity than the first substance, as a dispersion medium for dispersing the toner;

a cleaning portion configured to collect the liquid developer remaining on said image bearing member after the toner image is transferred onto the recording material;

a toner separating device configured to separate the liquid developer, fed from said cleaning portion, into the toner and the carrier liquid;

a carrier separating device configured to separate the carrier liquid, separated by said toner separating device, into the carrier liquid containing the first substance and the carrier liquid containing the second substance by applying an electric field to the carrier liquid; and a feeding path configured to feed the carrier liquid, containing the second substance separated by the carrier separating device, toward said image forming portion.

2. An image forming apparatus according to claim 1, wherein said carrier separating device comprises:

a rotatable electroconductive electrode roller;

an external electrode member, provided with a gap with part of said electrode roller, configured to form an electric field between itself and said electrode roller, wherein said external electrode member is capable of applying the electric field such that the first substance moves toward said electrode roller when the liquid developer passes through between said electrode roller and said external electrode member;

a supplying portion configured to supply the liquid developer, collected from said image forming portion, into the gap between said electrode roller and said external electrode member;

a collecting roller configured to collect the first substance from said electrode roller using an electric field, wherein said collecting roller is provided rotatably in contact with said electrode roller at a position downstream of said external electrode member and upstream of said supplying portion with respect to a rotational direction of said electrode roller; and a collecting portion configured to collect the second substance from said electrode roller, wherein said collecting portion is provided at a position downstream of said external electrode member and upstream of said collecting roller with respect to the rotational direction of said electrode roller.

3. An image forming apparatus according to claim 2, wherein when a line passing through a center of said electrode roller and a top of said electrode roller with respect to a direction of gravitation is 0°, an upstream end portion of said external electrode member with respect to the rotational direction of said electrode roller is positioned in a range of 0° or more and less than 180° with respect to the rotational direction of said electrode roller, and wherein a downstream end portion of said external electrode member with respect to the rotational direction of said electrode roller is positioned below the upstream end portion with respect to the direction of gravitation.

4. An image forming apparatus according to claim 1, further comprising a collecting unit mountable in and dismountable from said image forming apparatus, wherein the carrier liquid containing the first substance is collected in said collecting unit.

5. An image forming apparatus according to claim 4, wherein the toner separated by said toner separating device is collected in said collecting unit.

6. An image forming apparatus according to claim 1, further comprising, a carrier accommodating portion configured to accommodate a carrier to be supplied to said image forming portion, and a carrier supply container mountable in and dismountable from said image forming apparatus, wherein said carrier accommodating portion accommodates the carrier liquid containing the second substance and the carrier liquid supplied from said carrier supply container.

7. An image forming apparatus according to claim 6, further comprising, a toner supply container mountable in and dismountable from said image forming apparatus, and a mixer configured to mix the toner supplied from said toner supply container and the carrier supplied from said carrier accommodating portion, wherein the liquid developer is supplied from said mixer to said image forming portion.

8. An image forming apparatus according to claim 1, wherein the second substance has a substantially neutral charge polarity.

9. An image forming apparatus comprising:

an image forming portion, including an image bearing member, configured to form a toner image on a recording material with a liquid developer containing a toner and a carrier liquid, wherein the carrier liquid contains a first substance, charged to an opposite polarity to a charge polarity of the toner, for imparting an electrical polarity to the toner and a second substance, higher in volume resistivity than the first substance, as a dispersion medium for dispersing the toner;

a cleaning portion configured to collect the liquid developer remaining on said image bearing member after the toner image is transferred onto the recording material;

a toner separating device configured to separate the liquid developer, fed from said cleaning portion, into the toner and the carrier liquid;

a carrier separating device configured to separate the carrier liquid, separated by said toner separating device, into the carrier liquid containing the first substance and the carrier liquid containing the second substance by applying an electric field to the carrier liquid; and a collecting portion configured to collect each of the carrier liquid containing the first substance and the carrier liquid containing the second substance which are separated by said carrier separating device.

10. An image forming apparatus according to claim 9, wherein said carrier separating device comprises:

a rotatable electroconductive electrode roller;

an external electrode member, provided with a gap with part of said electrode roller, configured to form an electric field between itself and said electrode roller, wherein said external electrode member is capable of applying the electric field such that the first substance moves toward said electrode roller when the liquid developer passes through between said electrode roller and said external electrode member;

a supplying portion configured to supply the liquid developer, collected from said image forming portion, into the gap between said electrode roller and said external electrode member;

a collecting roller configured to collect the first substance from said electrode roller using an electric field, wherein said collecting roller is provided rotatably in contact with said electrode roller at a position downstream of said external electrode member and upstream of said supplying portion with respect to a rotational direction of said electrode roller; and a collecting portion configured to collect the second substance from said electrode roller, wherein said collecting portion is provided at a position downstream of said external electrode member and upstream of said collecting roller with respect to the rotational direction of said electrode roller.

11. An image forming apparatus according to claim 10, wherein when a line passing through a center of said electrode roller and a top of said electrode roller with respect to a direction of gravitation is 0°, an upstream end portion of said external electrode member with respect to the rotational direction of said electrode roller is positioned in a range of 0° or more and less than 180° with respect to the rotational direction of said electrode roller, and wherein a downstream end portion of said external electrode member with respect to the rotational direction of said electrode roller is positioned below the upstream end portion with respect to the direction of gravitation.

12. An image forming apparatus according to claim 9, further comprising a supplying device configured to supply the second substance, separated by said carrier separating device, to said image forming portion.

13. An image forming apparatus according to claim 9, further comprising a collecting unit mountable in and dismountable from said image forming apparatus, wherein the carrier liquid containing the first substance is collected in said collecting unit.

14. An image forming apparatus according to claim 13, wherein the toner separated by said toner separating device is collected in said collecting unit.

15. An image forming apparatus according to claim 9, further comprising, a carrier accommodating portion configured to accommodate a carrier to be supplied to said image forming portion, and a carrier supply container mountable in and dismountable from said image forming apparatus, wherein said carrier accommodating portion accommodates the carrier liquid containing the second substance and the carrier liquid supplied from said carrier supply container.

16. An image forming apparatus according to claim 15, further comprising, a toner supply container mountable in and dismountable from said image forming apparatus, and a mixer configured to mix the toner supplied from said toner supply container and the carrier supplied from said carrier accommodating portion, wherein the liquid developer is supplied from said mixer to said image forming portion.

17. An image forming apparatus according to claim 9, wherein the second substance has a substantially neutral charge polarity.

* * * * *